US006568233B2

(12) United States Patent
Iura et al.

(10) Patent No.: US 6,568,233 B2
(45) Date of Patent: May 27, 2003

(54) METHOD AND APPARATUS OF DIAMETRICALLY EXPANDING METAL SHAFTS

(75) Inventors: Tadashi Iura, Ehime (JP); Keiji Yamamoto, Ehime (JP); Kazuki Mori, Ehime (JP)

(73) Assignee: Iura Co., Ltd., Ehime (JP)

( * ) Notice: Subject to any disclaimer, the term of this patent is extended or adjusted under 35 U.S.C. 154(b) by 3 days.

(21) Appl. No.: 10/055,895

(22) Filed: Jan. 28, 2002

(65) Prior Publication Data

US 2002/0073755 A1 Jun. 20, 2002

Related U.S. Application Data

(62) Division of application No. 09/646,546, filed as application No. PCT/JP00/00237 on Jan. 19, 2000.

(30) Foreign Application Priority Data

| | | |
|---|---|---|
| Jan. 20, 1999 | (JP) | 11-51355 |
| Feb. 17, 1999 | (JP) | 11-82164 |
| Mar. 4, 1999 | (JP) | 11-103056 |
| Mar. 19, 1999 | (JP) | 11-116979 |
| Jun. 2, 1999 | (JP) | 11-155713 |
| Aug. 30, 1999 | (JP) | 11-242590 |

(51) Int. Cl.[7] ..... B21D 15/00

(52) U.S. Cl. ..... 72/111; 72/94; 72/101; 72/302; 72/370.19; 72/377

(58) Field of Search ..... 72/94, 101, 111, 72/125, 302, 305, 316, 370.19, 370.2, 377

(56) References Cited

U.S. PATENT DOCUMENTS

| | | | | | |
|---|---|---|---|---|---|
| 3,566,664 | A | * | 3/1971 | Schweizer | 72/402 |
| 4,606,214 | A | * | 8/1986 | Miyazaki | 72/318 |
| 5,522,247 | A | * | 6/1996 | Mitsubayashi et al. | 72/302 |
| 5,904,063 | A | * | 5/1999 | Owens | 72/316 |
| 6,282,939 | B1 | * | 9/2001 | Minamidate et al. | 72/370.19 |

FOREIGN PATENT DOCUMENTS

| | | |
|---|---|---|
| JP | 59-130641 | 7/1984 |
| JP | 6-65423 | 8/1994 |

* cited by examiner

*Primary Examiner*—Ed Tolan
(74) *Attorney, Agent, or Firm*—Armstrong, Westerman & Hattori, LLP

(57) ABSTRACT

Method and apparatus for diametrically expanding a desired part of a metal shaft which can be a rod or a pipe, wherein the apparatus includes a driving rotary section (4) and a driven rotary section (6) arranged at a predetermined distance (D), each of the rotary sections (4) and (6) including a holder for holding a work, a pressing device (8) for pressing the work held by the holders along the length of the apparatus, and a biasing device (7) for declining the axis of the work, so that the work held by the holders at the distance (D) is rotated around its axis, and one of the holders is forced by the pressing device toward the other to carry out the diametral expansion, and then the work is bent back and straightened up.

11 Claims, 37 Drawing Sheets

Fig.31
(a)
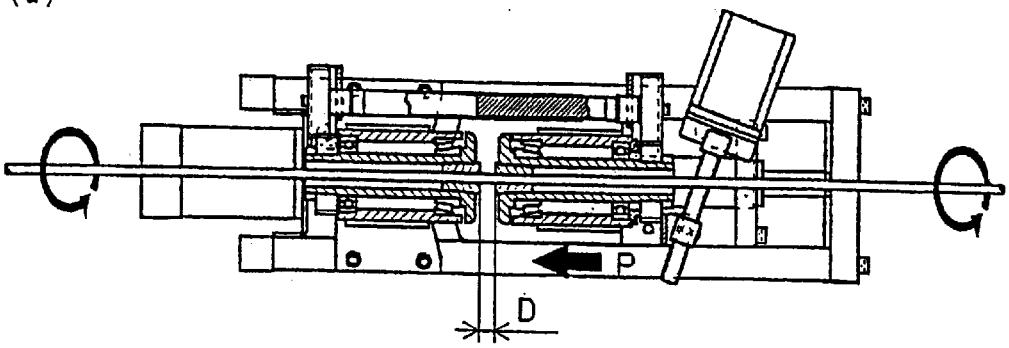
(b)
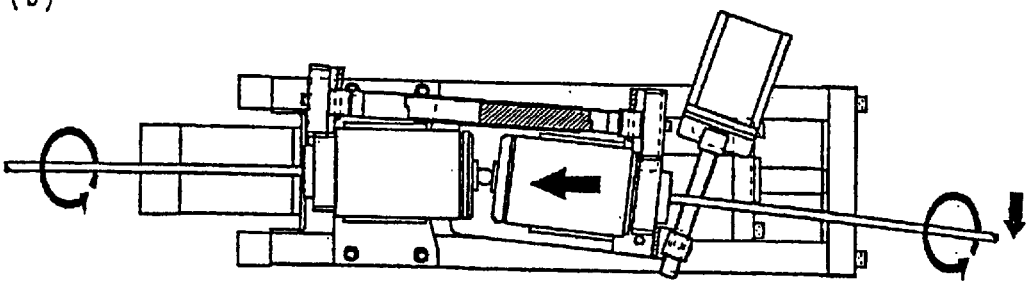
(c)
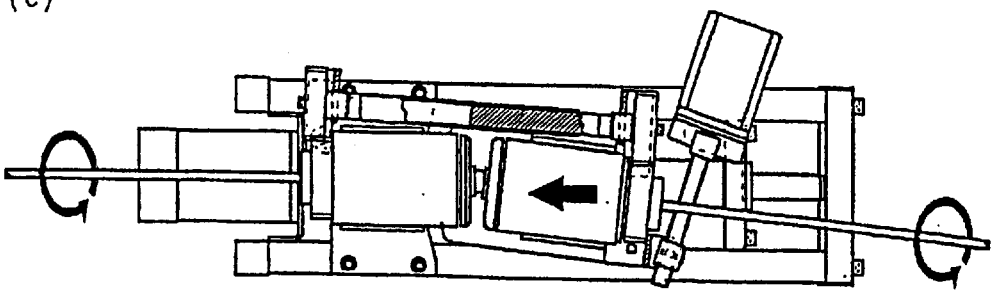
(d)
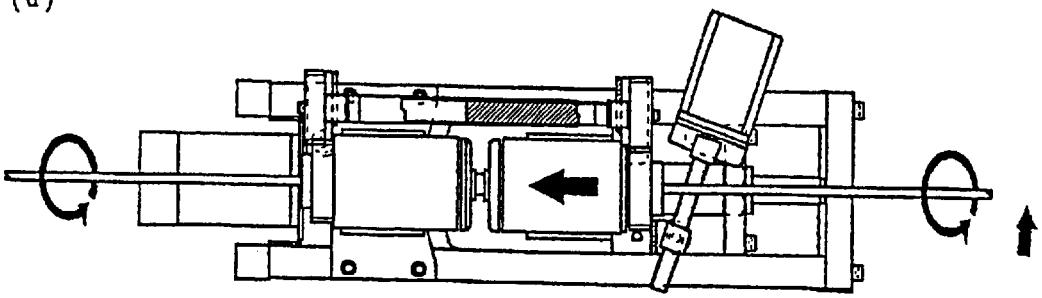

METHOD AND APPARATUS OF DIAMETRICALLY EXPANDING METAL SHAFTS

This application is a divisional of U.S. patent application Ser. No. 09/646,576 filed Nov. 2, 2000 which is a 35 USC 371 of PCT/JP00/00237 filed Jan. 19, 2000.

FIELD OF THE INVENTION

The present invention relates to a method and apparatus for diametrically expanding a desired portion, such as a middle portion, of metal shafts which can be solid like bars or tubular like pipes.

BACKGROUND ART

It is common practice to obtain a metal shaft having a locally increased diameter by machining a blank shaft of a relatively large diameter. However, this machining process disadvantageously takes time, and what is worse, tends to waste metal as cutting chips.

In general, the mechanical power transmission shafts require the provision of components such as gears, cams, and sprockets whose diameter is larger than that of the shafts. In order to provide the metal shafts with these components, a mechanical method is not economical where the metal flesh of a shaft is machined to form gears as integral parts. An alternative way is to produce those component parts on a separate process, and join them to the shafts by welding or bolting. This method is not efficient. Therefore, a metallurgical process was proposed for forcing a metal shaft to diametrically expand in a desired portion, and cutting gears or cams there. However, it has been considered to be impracticable to put the proposed metallurgical method in practice.

The inventor of the present application invented a method of expanding the diameter of a metal shaft in its middle portion through rotation, bending and compression, which is disclosed in Japanese Patent No. 1,993,956. This metallurgical method has overshadowed the conventional mechanical method, and made it possible to form gears or cams in the diametrically expanded portion of a metal shaft.

According to the previous invention referred to above, the metal shaft is subjected to rotation and bending under a sufficient compression until a diametrically expanded portion is obtained, and after the shaft is bent back, the rotation and bending are stopped. If the compressive force is too large, the shaft must be held firmly to withstand it. In contrast, if it is too low, an increased number of rotations is required until a desired shape is obtained, thereby taking a long time before the desired portion of the shaft is diametrically expanded. A further disadvantage is the lack of precision involved in a pair of rotary holders provided in the apparatus, one having a biasing means for bending the work, and the other having a pressing means for causing one holder to approach the other.

Accordingly, one object of the present invention is to provide a method and apparatus capable of performing a local diametral expansion of a metal shaft efficiently and accurately.

Another object of the present invention is to provide a method and apparatus capable of careful inspection of deformation likely to occur in a metal shaft in view of the insufficient analysis on the mechanism of the diametral expansion of a metal shaft.

A further object of the present invention is to provide a method and apparatus capable of diametrically expanding a portion of a metal shaft to a collar-like shape of any size.

A still further object of the present invention is to provide a method and apparatus capable of diametrically expanding a metal shaft with no detrimental torsion in the metal shaft, which would otherwise decrease the tensile strength of the metal shaft after the diametral expansion is finished. The torsion results from the fact that one of the rotary holders is subjected to a torque which is transmitted to the other holder through the solid work.

Another object of the present invention is to provide a method and apparatus capable of diametrically expanding a metal shaft with use of a conventional lathe.

SUMMARY OF THE INVENTION

The present invention provides a method for diametrically expanding a predetermined part of a metal shaft, including the steps of holding the shaft between a pair of holders spaced at a distance (D); rotating the work around its axis, moving one of the holders toward the other holder so as to compress the work; biasing one of the holders in a direction which crosses the axis of the other holder, so as to bend the work and build up bulged portions accruing inside the bent portion around the periphery of the work within the distance (D) until a desired expansion is achieved; and straightening up the work, wherein the compression is constantly applied to both the inner and outer sides of the work to be bent, and the rotation is initiated at the latest immediately after the bending is started, and the straightening-up is performed under the continued compression and rotation.

In this ease, the compression is relatively low at the initial stage of the diametral expansion, and increases in accordance with the advance of the expansion.

The present invention also provides an apparatus for carrying out the above-mentioned method, including a driving rotary section and a driven rotary section arranged at a predetermined distance, each of the rotary sections comprising holders for securing a work therebetween; a driver for operating the driving rotary section; a pressing device for axially compressing the work held by the holders; and a biasing device for declining the axis of the work; wherein the pressing device applies the compression to one of the rotary sections, and the biasing device declining the other rotary section.

According to another aspect of the invention, the apparatus includes a driving rotary section and a driven rotary section arranged at a predetermined distance, each of the rotary sections comprising holders for securing a work therebetween; a driver for operating the driving rotary section; a pressing device for axially compressing the work held by the holders; and a biasing device for declining the rotary section so as to cause the work to decline with respect to its axis; wherein either the driving rotary section or the driven rotary section is arranged rotatably around a pivot provided in a direction perpendicular to the axis of the work, and the rotatably arranged rotary section is supported by the pivot so as to enable the simultaneous inspection of the inner and outer sides of the bent portion of the work.

As a further preferred embodiment the apparatus can be provided with a slidable frame on the base plate, and a rotary framework rotatably connected to the slidable frame through a bearing, and wherein the driving rotary section is secured to the base plate and the driven rotary section is secured to the rotary framework.

As another preferred embodiment, especially suitable for processing a work having a relatively large diameter, the apparatus includes a driving rotary section and a driven rotary section arranged at a predetermined distance, each of the rotary sections comprising holders for securing a work therebetween; a driver for operating the driving rotary section; a pressing device for axially compressing the work held by the holders; and a biasing device for declining the rotary section so as to cause the work to decline with respect to its axis; wherein the pressing device applies the compression to one of the rotary sections, and the biasing device declining the other rotary section.

In this case, the apparatus can be provided with a displacing device for shifting the center of rotation between the holders in accordance with a sliding distance covered by the pressing device.

As a further preferred embodiment the apparatus includes a pair of rotary sections; a holder provided in each of the rotary sections for holding a work; a sliding device for causing at least one of the rotary sections to move toward and away from the other rotary section; a biasing device for declining at least one of the rotary sections with respect to the axis of the other rotary section; a driver for rotating the work held by the holders around its axis; and a transmission for transmitting the torque of one rotary section to another so as to effect the synchronous rotation of the two rotary sections.

More specifically, the transmission includes a rotating division in which rotatable brackets are provided, having a pair of splines interposed between them, the splines comprising gears engaged with follower gear provided in the rotating division, thereby transmitting a torque of one of the rotating division to the other.

As a more practical embodiment the apparatus includes a driving rotary section provided with a first work holder and being capable of rotating the work held by the holder; a driven rotary section provided with a second work holder on an opposite side to the holder of the driving rotary section and being capable of moving toward and away from the driving rotary section; a biasing device for declining the second holder with respect to the axis of the first holder; and a pressing device for pressing the driven rotary section toward the driving rotary section; wherein the driving rotary section is driven by an arrangement in which the first work holder is connected to a chuck of a lathe so as to utilize the torque of the lathe.

In this case the pressing device is preferably placed between a base plate and a slidable frame, and wherein the base plate is provided with a tapered shaft, the tapered shaft and the first work holder being connected to the lathe, thereby compensating a repulsive force involved in operating the pressing device within the base plate.

BRIEF DESCRIPTION OF THE DRAWINGS

FIG. 10 is a cross-sectional side view of a driven rotary section incorporated in the apparatus shown in FIG. 6;

FIGS. 31*a*–31*d* are a schematic view of the apparatus shown in FIG. 30 when it is in the process of performing the diametral expansion;

DETAILED DESCRIPTION OF THE PREFERRED EMBODIMENTS

Figure 1:
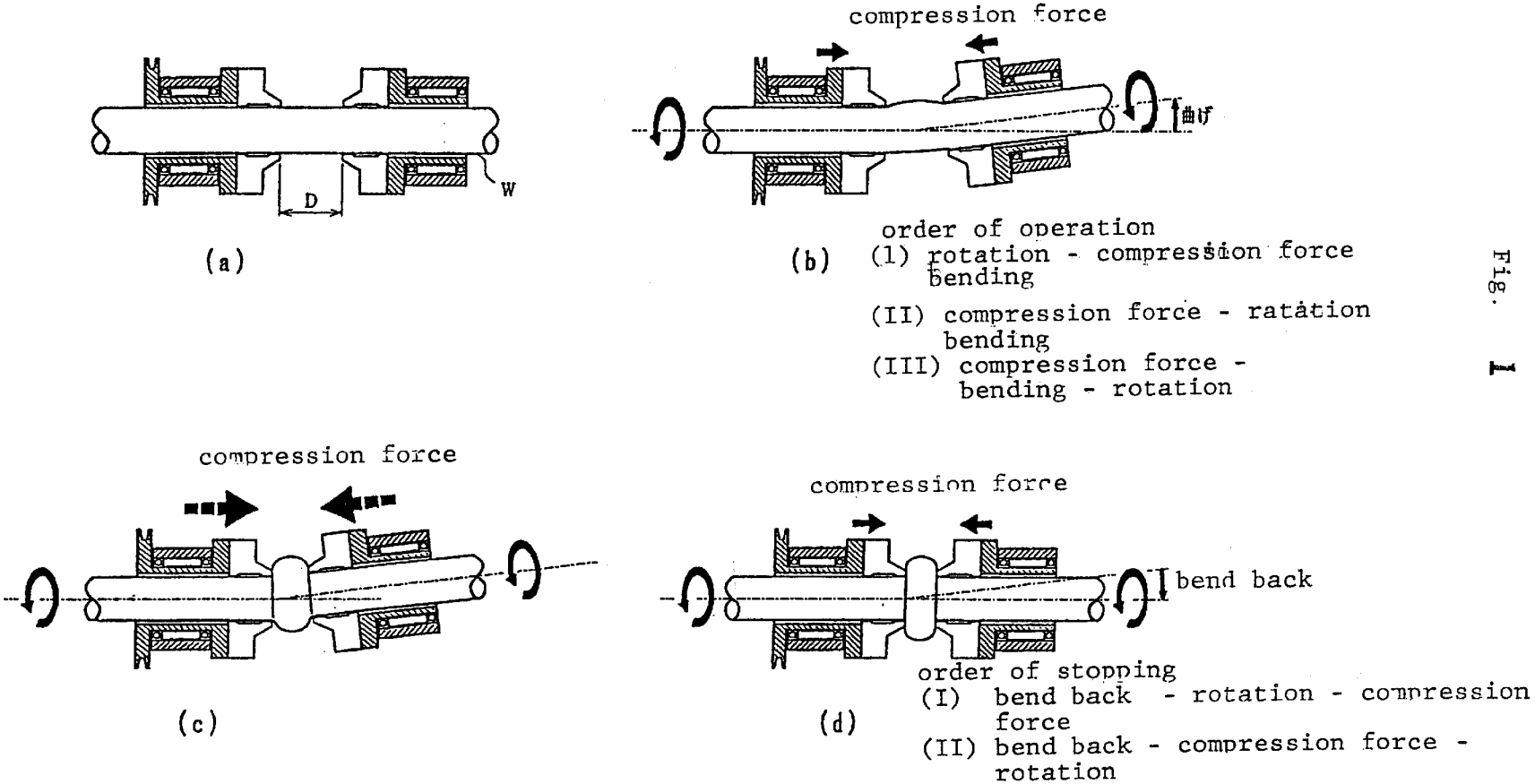
FIGS. 1*a* to 1*d* are schematic views explaining the process of performing a method according to the invention.
Figure 2:
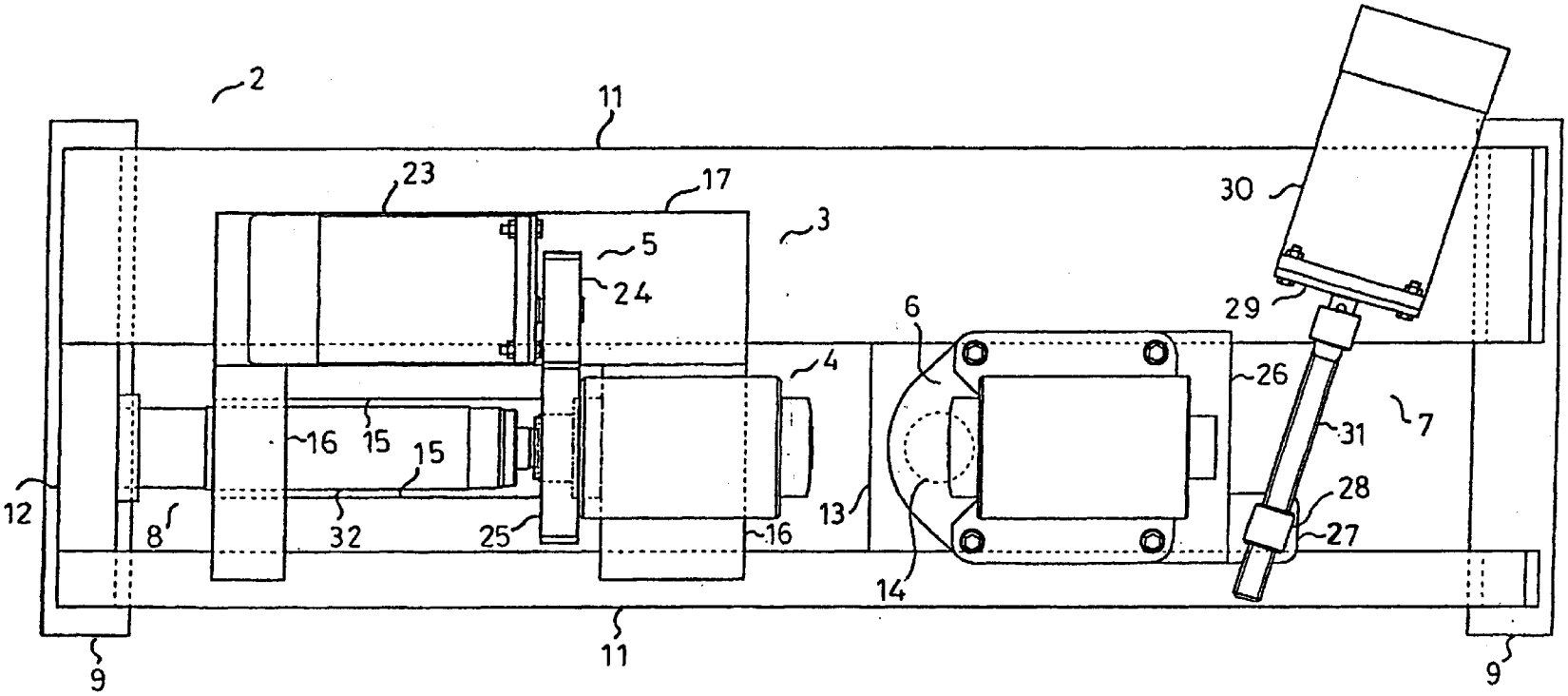
FIG. 2 is a plan view of an apparatus according to the invention.
Figure 3:
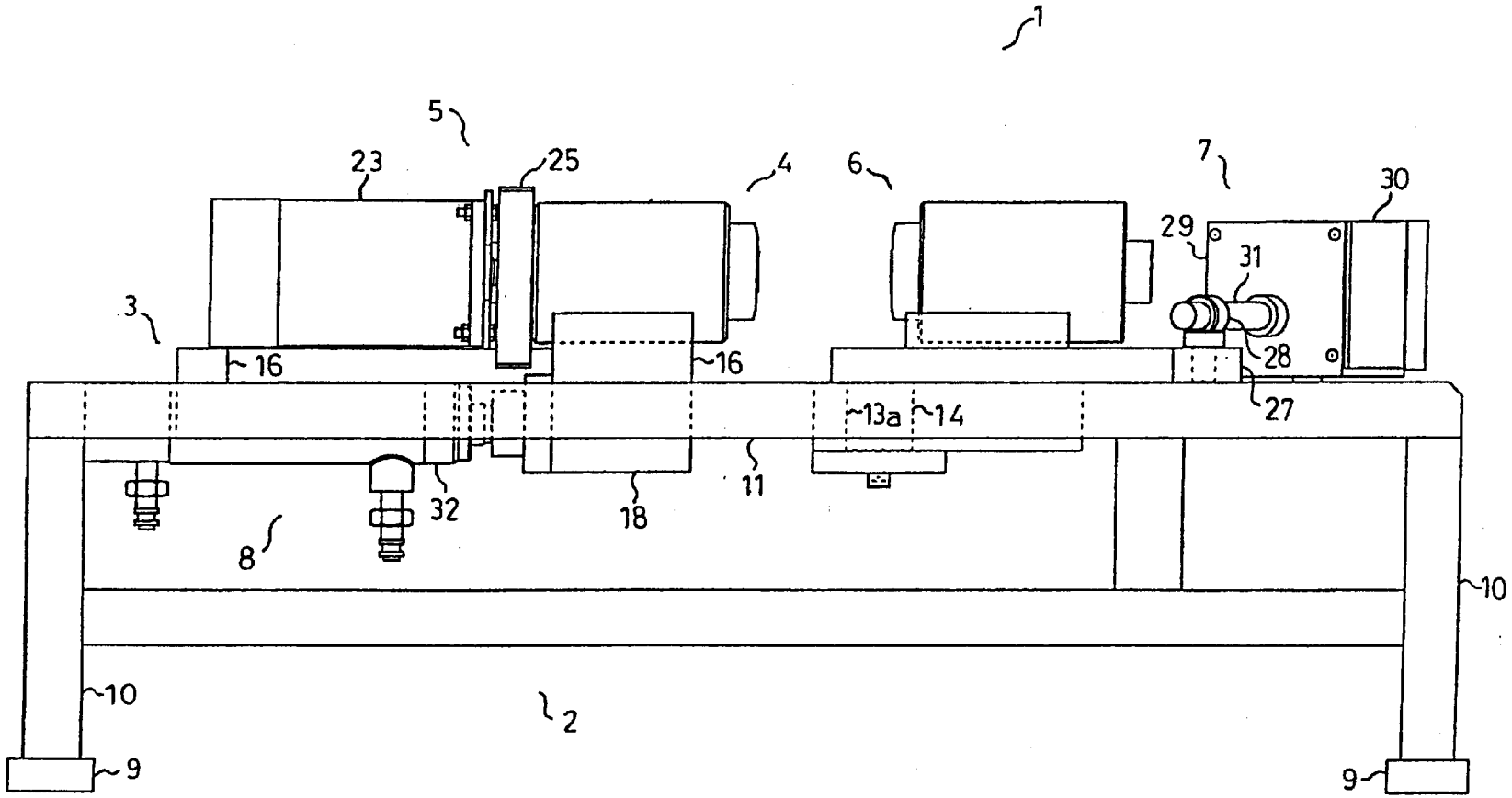
FIG. 3 is a side view of the apparatus shown in FIG. 2.
Figure 4:
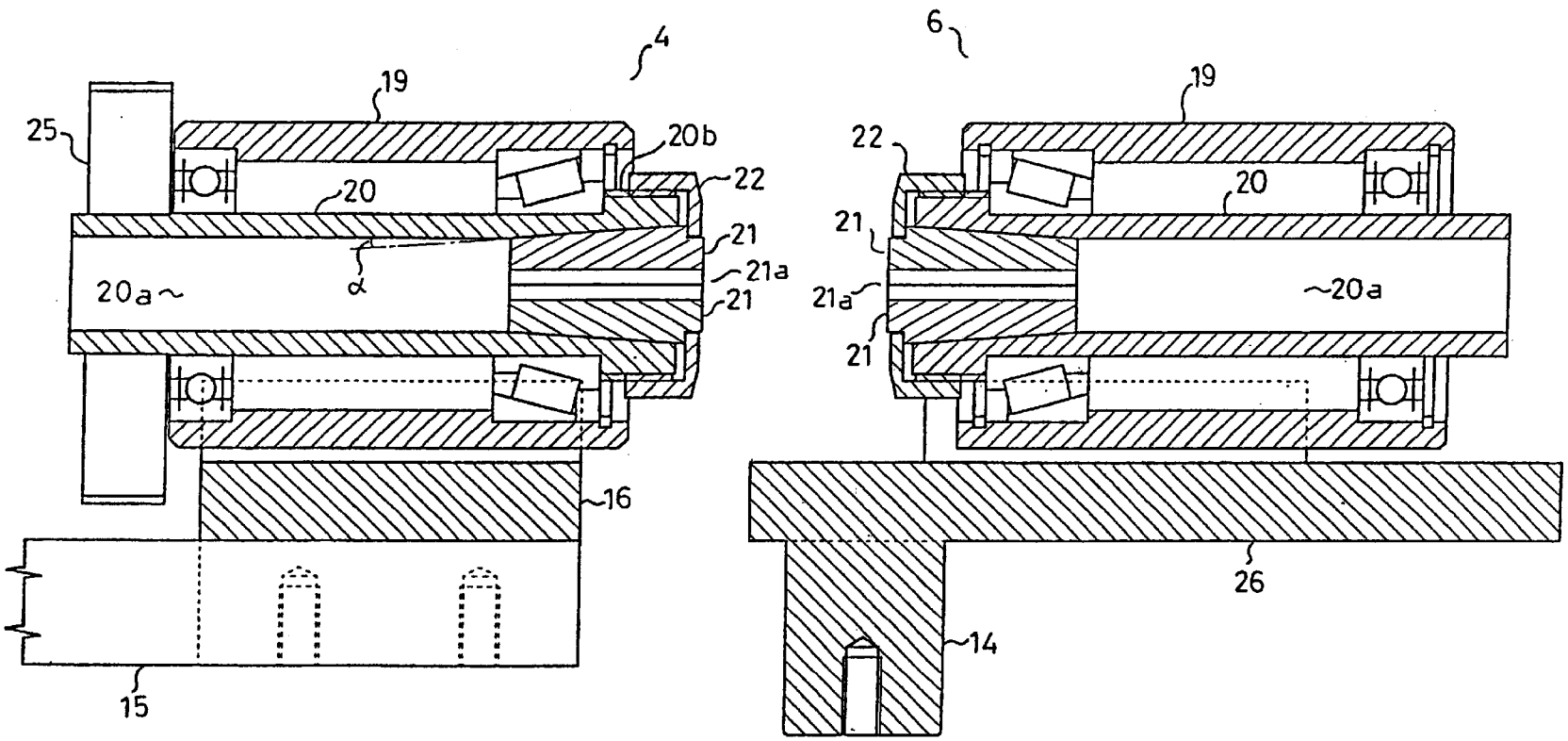
FIG. 4 is a cross-sectional side view of a rotary holder incorporated in the apparatus shown in FIG. 2.
Figure 5:
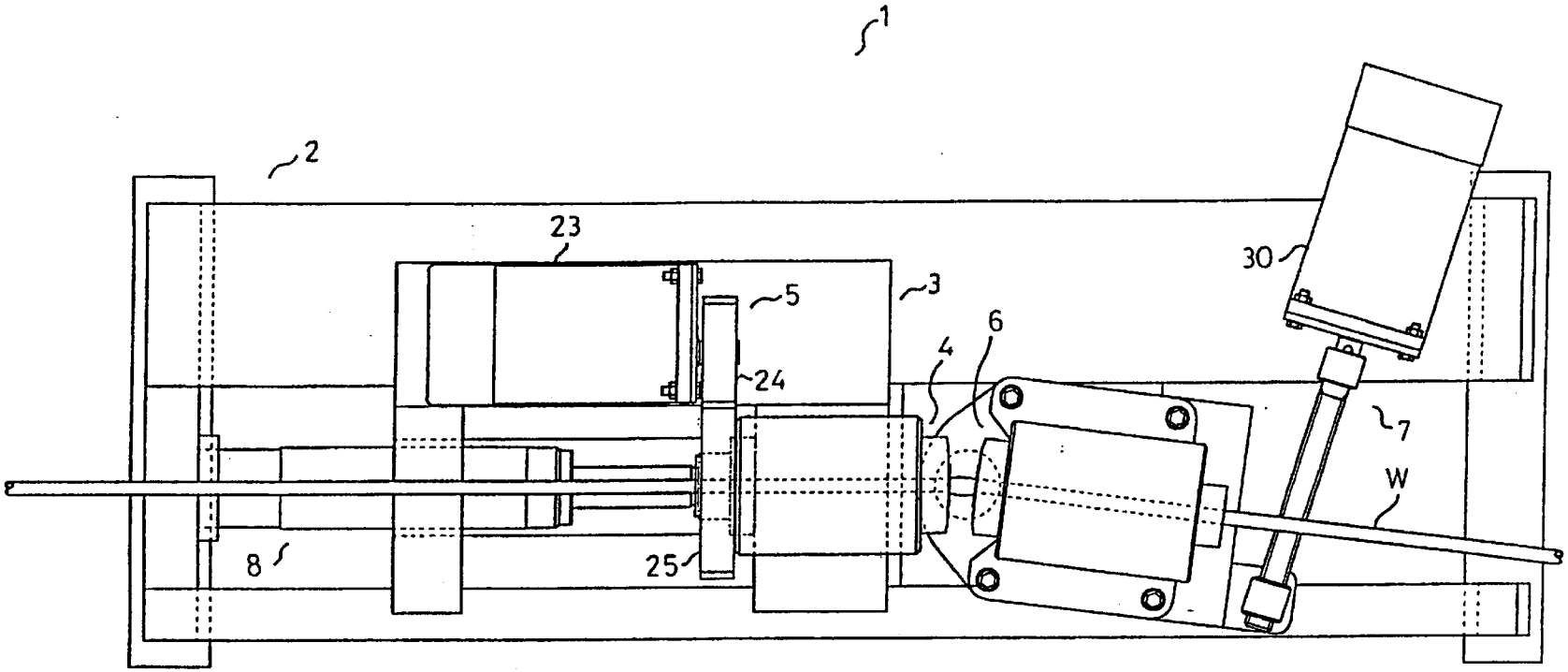
FIG. 5 is a plan view of the rotary holder shown in FIG. 4
Figure 6:
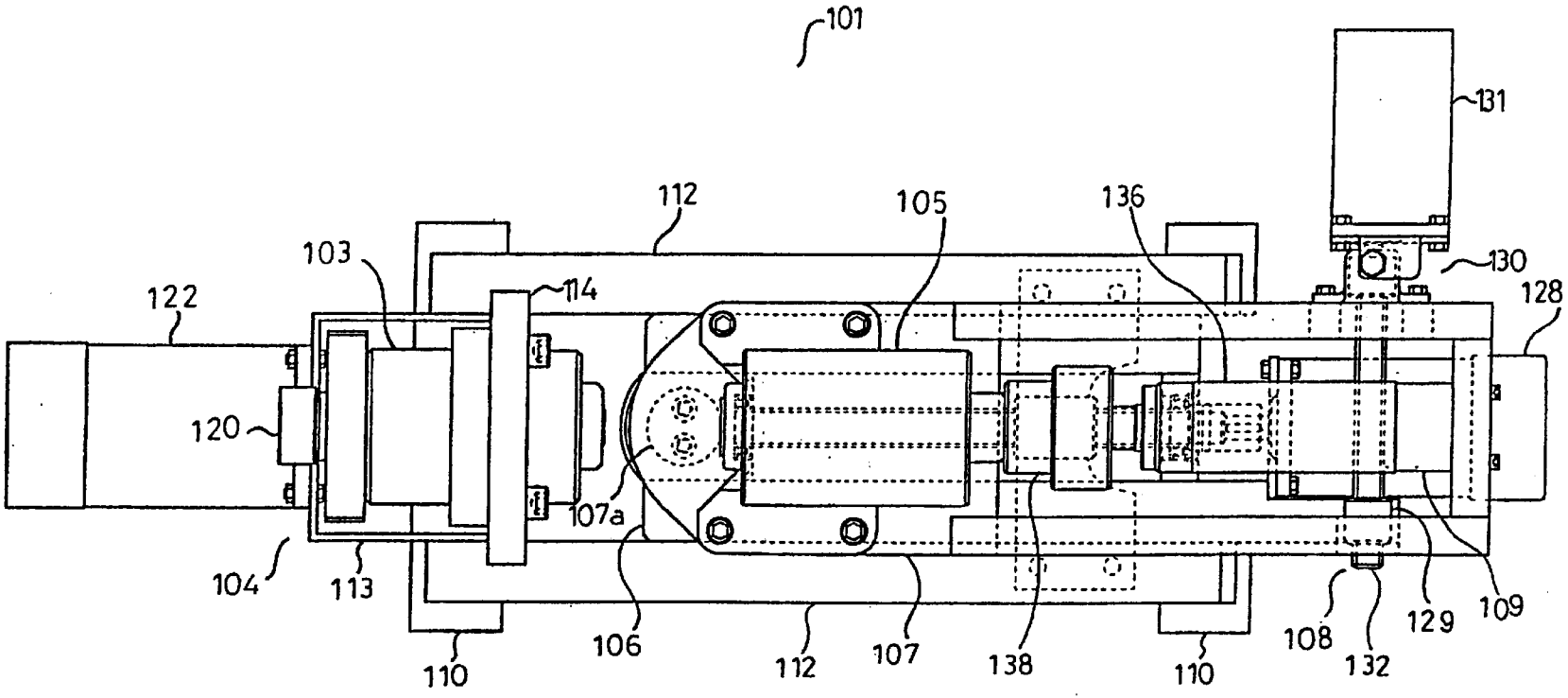
FIG. 6 is a plan view of an apparatus according to another embodiment of the invention.
Figure 7:
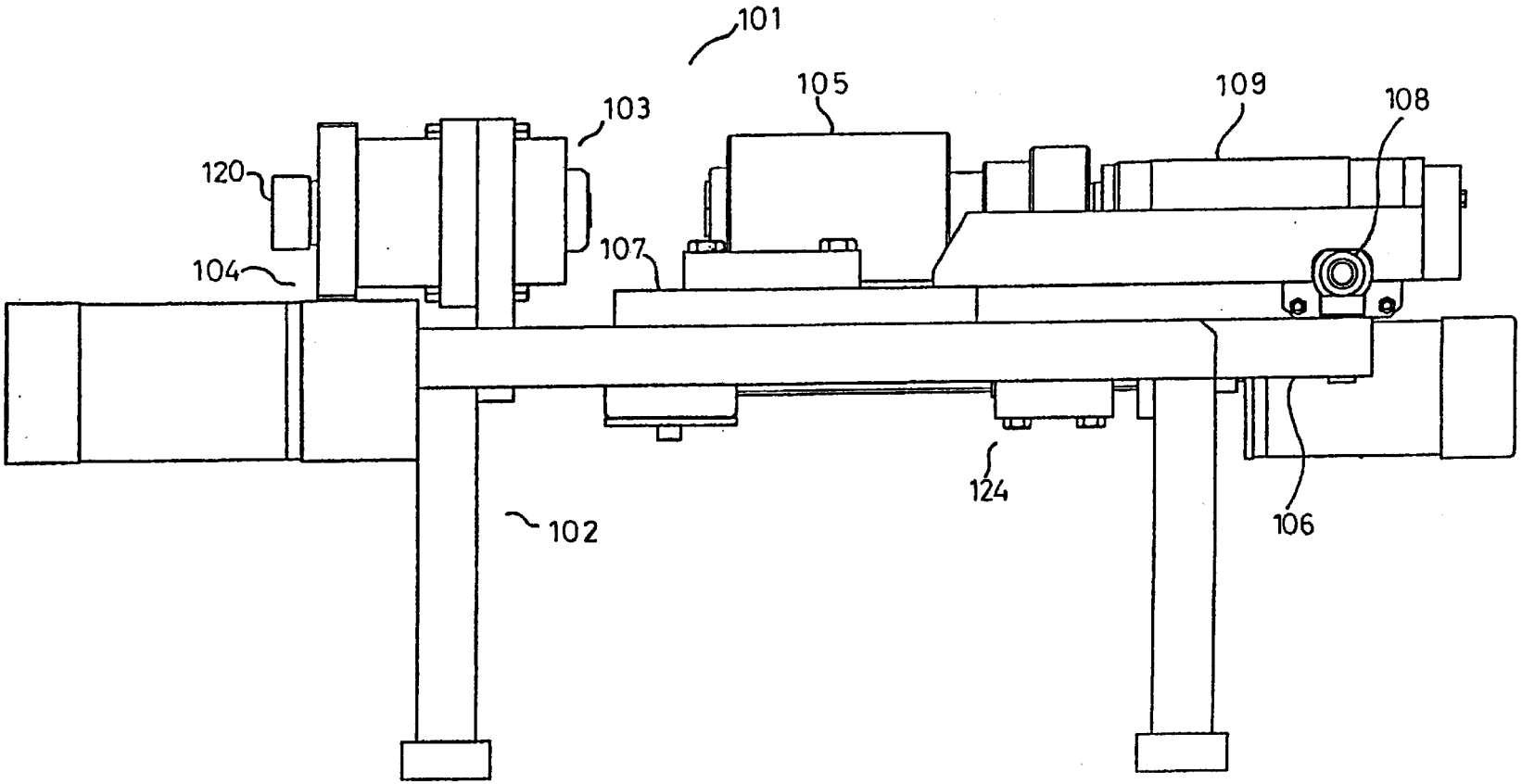
FIG. 7 is a side view of the apparatus shown in FIG. 6.
Figure 8:
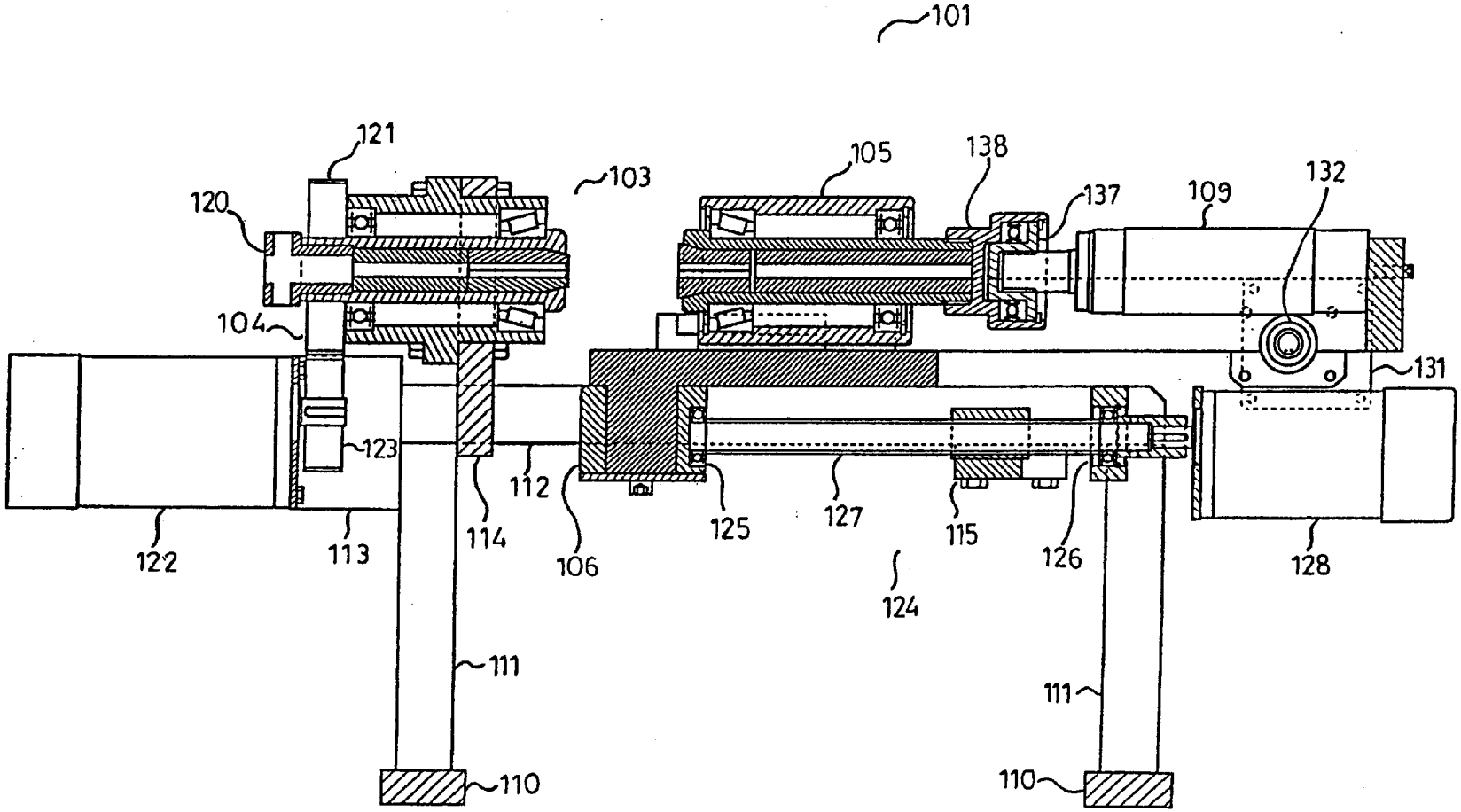
FIG. 8 is a cross-sectional side view of the apparatus shown in FIG. 6.
Figure 9:
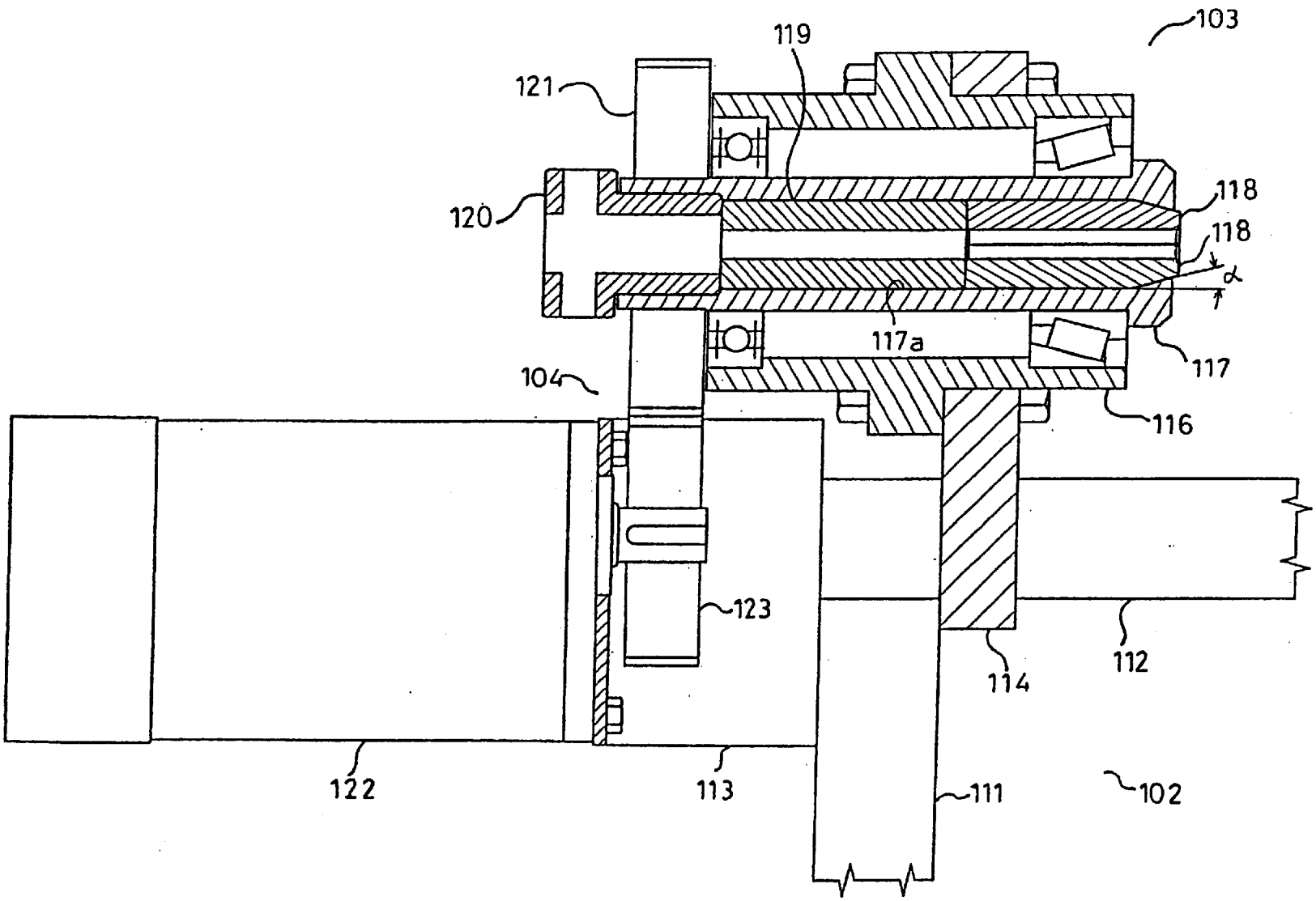
FIG. 9 is a cross-sectional side view of a driving rotary section incorporated in the apparatus shown in FIG. 6.
Figure 1:
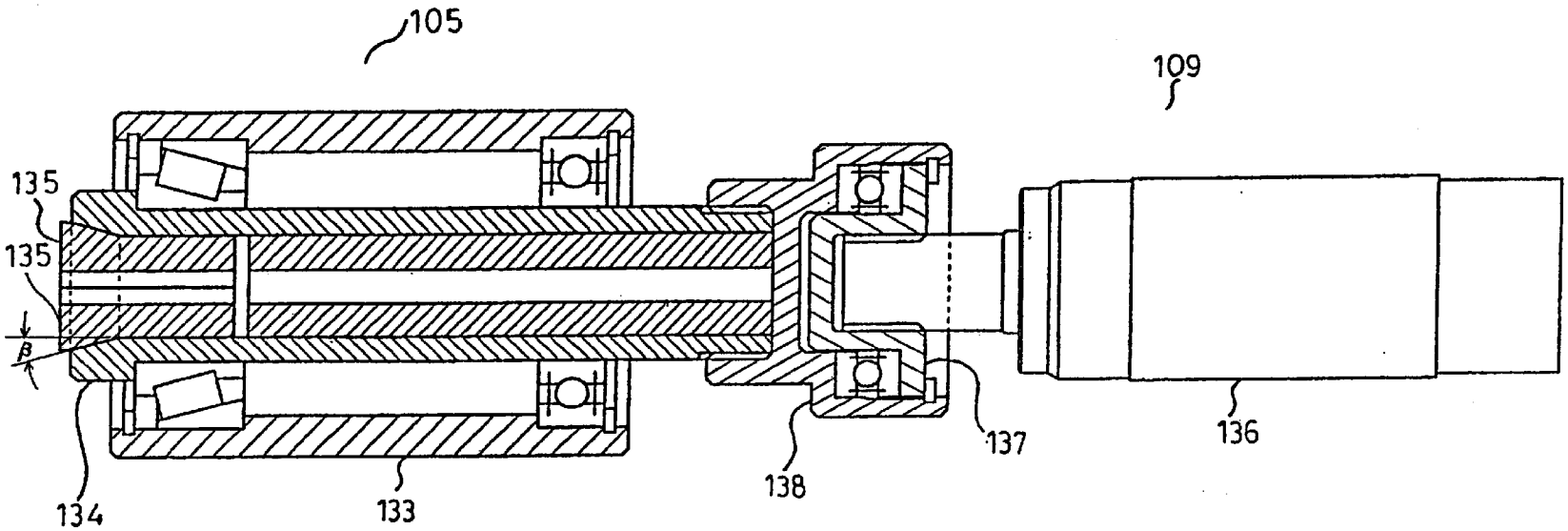
Figure 11:
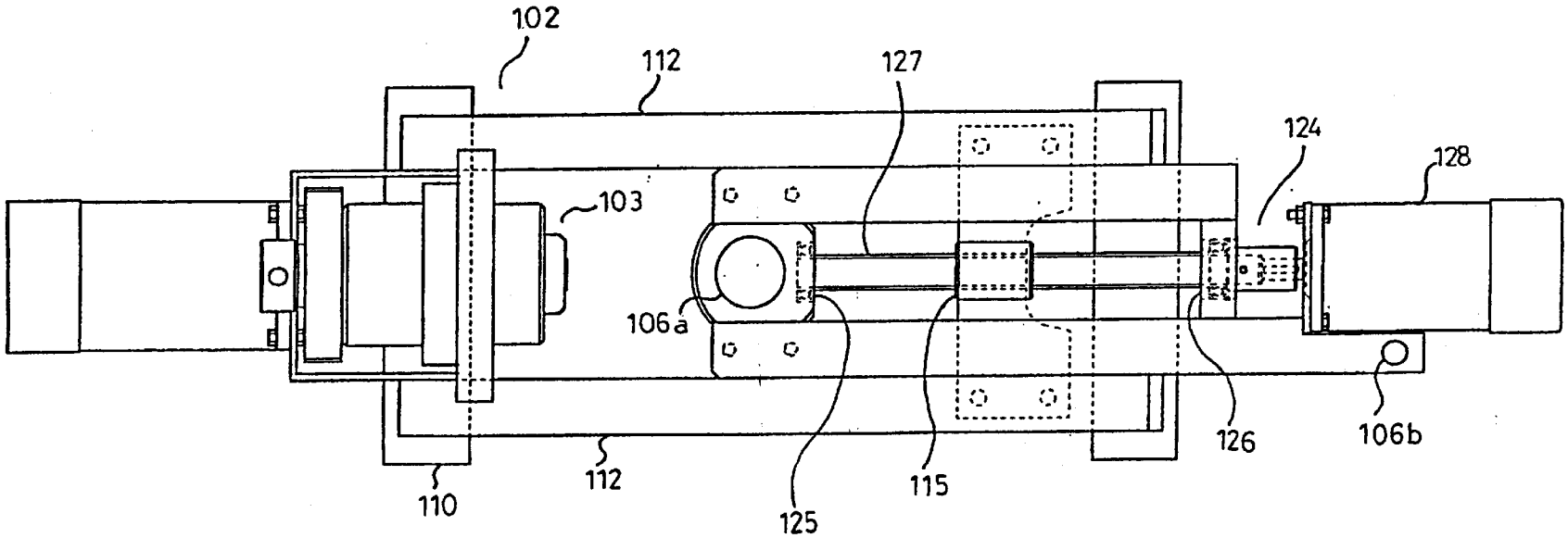
FIG. 11 is a plan view of a feeder incorporated in the apparatus shown in FIG. 6.

Referring to FIGS. 1*a,* 1*b,* 1*c* and 1*d,* respectively, the principle underlying the present invention will be described:

A pair of holders are co-axially arranged or aligned to hold a work (W) between them, wherein the work (W) can be solid or tubular. The holders are spaced by a distance (D) (FIG. 1*a*). Then, compression is axially applied until the work (W) is inwardly bent between the holders, and rotation is imparted to it as shown in FIG. 1*b*. The bending diametrically expands a portion in the work. The applied compression negates a possible pull which would otherwise act on the work, and therefore is stepped up. The rotation is effective to equal the diametral expansion around the periphery of the work (W). To this end, it is preferable that the work (W) is rotated while being subjected to the compression. The rotation can be started at any time.

The work (W) kept in the above-mentioned conditions is rotated several times. The sides of the diametrically expanded portion extends to each holding part, and are subjected to the compression. In this way the compression is stepped up. This means that the initial compressive force can be low, thereby reducing the holding force of each holder upon the work (W). As the compression is continued, the compressive force increases to shorten the operation hour (FIG. 1*c*). After the desired diametral expansion is finished, the work (W) is bent back until it becomes straight while the compression and rotation are repeated as shown in FIG. 1*d*. After the work (W) is straightened up, the rotation and compression are stopped, wherein either stoppage can be earlier than the other.

Referring to FIGS. 2 to 5, a first preferred embodiment of the present invention will be more particularly described:

The illustrated apparatus is a collar forming apparatus (hereinafter 'apparatus') 1 which is provided with a stand 2 on a floor, a rotary framework 3 axially slidable on the stand 2, a driving rotary holder 4 mounted on the rotary framework 3 and driven by a motor 5, and a driven rotary holder 6 located on the opposite side to the driving rotary holder 4, a biasing device 7 for declining the driven rotary holder 6 with respect to the axis of the driving rotary holder 4, and a pressing device 8 for pressurizing the driving rotary holder 4 toward the driven rotary holder 6; in other words, for compressing the driving rotary holder toward the driven rotary holder 6.

The stand 2 is composed of pillars 10 which are mounted on base plates 9, and parallel rails 11 spacedly arranged between which the pressing device 8 is fixed to a first support 12 at a front section of the apparatus 1. The driven rotary holder 6 is fixed to a second support 13 in the middle of the apparatus 1. The second support 13 is provided with a bore 13*a* in which a pivot 14 rests so as to allow the holder 6 to rotate.

The rotary framework 3 mounted on the stand 2 includes side frames 15 axially arranged, transverse frames 16 fixed on the top of the side frames 15, and a stand 17 on which a motor is mounted. The rotary framework 3 is crosswise limited by the side frames 15, and vertically limited by the transverse frames 16. In this way the axial movement of the rotary framework 3 is effected along the rails 11. Preferably, a lower framework 18 is provided in a lower part of the framework 16.

The driving rotary holder 4 is provided on the rotary framework 3. The holder 4 includes a supporting sleeve 20 rotatably carried within a sleeve 19 secured to the rear framework 16. The supporting sleeve 20 is provided with a chamber 20*a* whose end is outwardly tapered at an angle is $\alpha°$ toward the other holder 6, and also provided with a threaded portion 20*b* on and around the tapered end. The chamber 20 houses chucks 21 each of which has a tapered outside wall corresponding to the tapered inside wall of the chamber 20*a*. The chuck 21 is obtained by splitting the body into a plurality of portions and forcefully inserted in the chamber 20*a*. The end portion of the holder 20 is covered with a fastening nut 22 with its inner space 21*a* being open. The work (W) is forced into the inner space 21*a,* and becomes held therein.

The rotary holder 4 is associated with a driving means 5, which is an electric motor 23 in the illustrated embodiment, to receive a driving force therefrom. The motor 23 has an output shaft provided with a driving gear 24 engaged with a driven gear 25 located in the front end of the holder 20.

Being arranged opposite the driving rotary holder 4, the driven rotary holder 6 has the same structure as the holder 4. The holder 6 is fixed to a rotary plate 26 connected to the pivot 14 which is carried in the bore 13*a* of the second support 13. In this way the holder 6 is rotated in such a manner that it become biased with respect to its axis. The holders 4 and 6 are aligned, and ratable around the pivot 14.

The biasing device 7 is provided to rotate the driven rotary holder 6. It includes a nut 28 rotatably connected to a bracket 27 of a rear end of the rotary plate 26, a motor 30 secured to a rotary plate 29 provided on the rails 11, the output shaft of the motor 30 having a thread portion 21 engaged with the nut 28. The rotation of the motor 30 in either direction causes the thread portion 21 to rotate around the rotary plate 26, but the nut 28 does not rotate because of its fixation to the bracket 27. In this way the driven rotary holder 6 is rotated in a horizontal plane. The biasing device 7 is not limited to this embodiment but can be a version in which the rotary holder 6 is rotated around the pivot 14 with the addition of a link-system pressing device or a fluid-system pressing device which causes the work (W) to become biased by applying a force to it in a directon which crosses the axis of the work (W).

The pressing device 8 is provided in the rear lower part of the driving rotary holder 4. This device 8 compresses the driving rotary holder 4 toward the driven rotary holder 6. It is constructed with a double-acting hydraulic cylinder 32 secured to the stand 2 at one end and to the slidable framework 3 at the other end. Instead of the hydraulic cylinder 32, a hydraulic jack or a fluid cylinder can be employed.

No controller is illustrated in the drawings for the motors 23 and 30, and the hydraulic cylinder 32 but it can be designed to optionally set the rotations per minute of each motor 23 and 30 and a pressure provided by the cylinder 32. The angle of the biasing device 7 can be adjusted as desired.

In making a desired local diametral expansion, the rotary holders 4 and 6 are aligned, and the chucks 21 of both holders are spaced at a predetermined distance (D) between which a work (W) is placed, and held by the nut 22.

The hydraulic cylinder 32 is operated so that the work (W) is bent until it is compressed. Then the motor 30 is driven to further bend the work (W) at 3 to $7^0$. The time for driving the motor 30 is optional.

The rotation continues several times, thereby causing the local diametral expansion to grow and at the same time, subjecting its surrounding to the compressive pressure. Therefore, no slip occurs between the work (W) and the chucks 21 in spite of an increase in compression. Owing to the increased compressive pressure, the local diametral expansion can be finished in a short time.

When the local diametral expansion is finished, the work (W) is bent back to straighten up. Then the motor 23 and the hydraulic cylinder 32 are deenerzied.

The work (W) is withdrawn out of the holders simply by loosening the nut 22.

As evident from the foregoing description, the apparatus of the invention does not require a large force for holding the work (W), thereby allowing the employment of a simplified mechanism. In addition, owning to the separate provision of the presser and the biasing device, a high degree of precision is achieved in the local diametral expansion.

FIGS. 6 to 15 show another embodiment of the present invention. The illustrated apparatus 101 is provided with a stand 102 on a floor, a driver section 103 mounted on the stand 102 driven by a driving unit 104, a driven rotary section 105 located opposite supported by a slidable framework 106 and a rotary framework 107, a biasing device 108 provided between the framework 106 and the rotary framework 107 to cause the work (W) to become biased, and a pressing device 109 provided in the rear end of the driven rotary section 105.

The stand 102 includes pillars 111 erected on plates 110, and frames 112 arranged in parallel along the length of the apparatus on the top of the pillars 111, a driving means mount 113 in and between front ends of the frames 112, a driving rotary section mount 114 in its rear end, and a nut 115 for slidable use in the rear end of the mount 114.

The driver section 103 includes an outer sleeve 116 in which an inner sleeve 117 is rotatably carried. The inner sleeve 117 has female threads on its inside wall which is tapered at $\alpha^0$ at the end. The inner sleeve 117 houses a pair of chucks 118 for holding the work (W). The chuck 118 is made by splitting one body into a plurality of chuck pieces, each of which is tapered at $\alpha^0$. A hollow core 119 is inserted in the inner sleeve 117 such that it can push the inner sleeve by a hollow bolt 120. By fastening the bolt 120, the chucks 118 are moved by the core 119, so that the tapered top ends of the chucks 118 are restricted to press the work (W).

The driving unit 104 includes a driven gear 121 in the front end of the inner sleeve 117, and the driving means mount 113 includes a motor 122 whose output shaft having a thread 123 engaged with the driven gear 121.

Opposite the driver section is 103 provided a driven rotary section 105 secured to the rotary framework 107, which is provided on the framework 106 arranged between the frames 112.

The framework 106 is provided with a feeder 124 designed to cause the driven rotary section 105 to approach or separate from the driver section 103. The feeder 124 is provided with a pair of bearings 125 and 126 on opposite ends between which a feed screw 127 is carried in engagement with a nut 115 provided on the stand 102. The feeder screw 127 is rotatable in either direction, thereby causing the framework 106 to move along the length of the apparatus. The rear end of the feeder screw 127 is connected to an output shaft of a motor 128 provided on the framework 106. The energization of the motor 128 drives the feeder screw 127.

The biasing device 108, designed to cause the work (W) to become biased with respect to its axis, rotates the rotary framework 107, which is integral with the driven rotary section 105, in a horizontal plane on the top surface of the frames 112. The biasing device 108 includes a pivot 107*a* in a bore 106*a* produced in the framework 106 such that the rotary framework is rotatable around the pivot 107*a*. A nut 129 is fitted in an opening 106*b* in the rear end of the framework 106, and a motor 131 is provided on a bracket 130 secured to the rotary framework 107. The output shaft of the motor 131 is provided with a thread portion 132 which is engaged with he nut 129. The rotation of the motor 131 in either direction causes the thread portion 132 to rotate in a clockwise or anti-clockwise direction. Since the nut 129 is rotatably connected to the framework 106, the nut 129 does not move, and the thread portion 132 rotates the rotary framework 107. In this way the driven rotary section 105 rotates in a horizontal plane around the pivot 107*a*. The biasing device 108 is not limited to this embodiment, but can be a version in which the driven rotary section 105 is rotatable around the pivot 107*a* under a linkage pressing system or a fluid cylinder, thereby applying force to the work (W) at right angle to its axis, thereby causing the work to become biased.

The driven rotary section 105, secured to the upper part of the rotary frame 107, includes an outer sleeve 133 in which an inner sleeve 134 having an inside space 134*a* is rotatably housed. The inner sleeve 134 has an inside wall tapered at $\beta°$ at its front end. The inner sleeve 134 houses chucks 135 for holding the work (W). The chucks 135 are produced by splitting a hollow cylinder into a plurality of chuck pieces whose outsides are tapered at $\beta°$. The chuck pieces are compressed by the pressing device 109, thereby holding the work (W) in a restricted space 134*a*.

Figure 12:
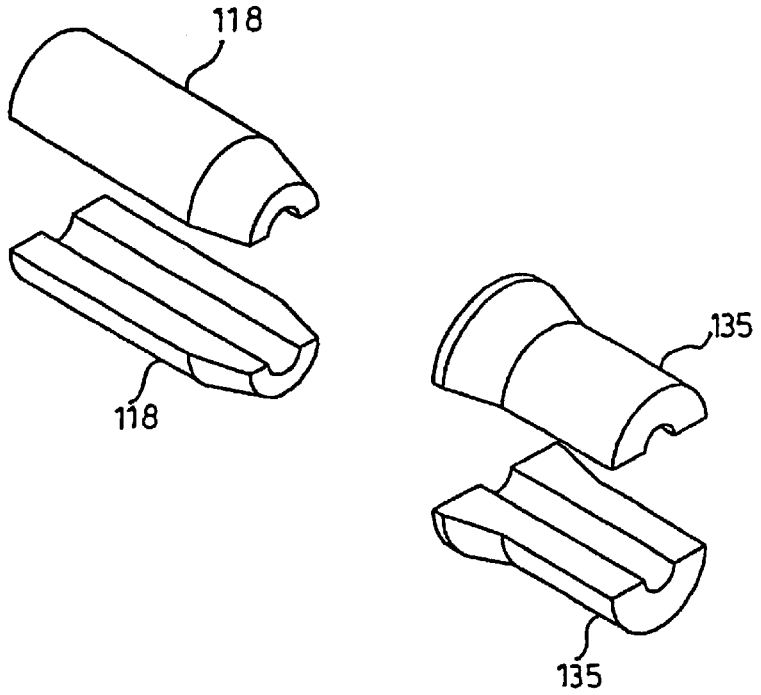
FIG. 12 is a perspective view of chucks incorporated in the apparatus shown in FIG. 6.
Figure 13:
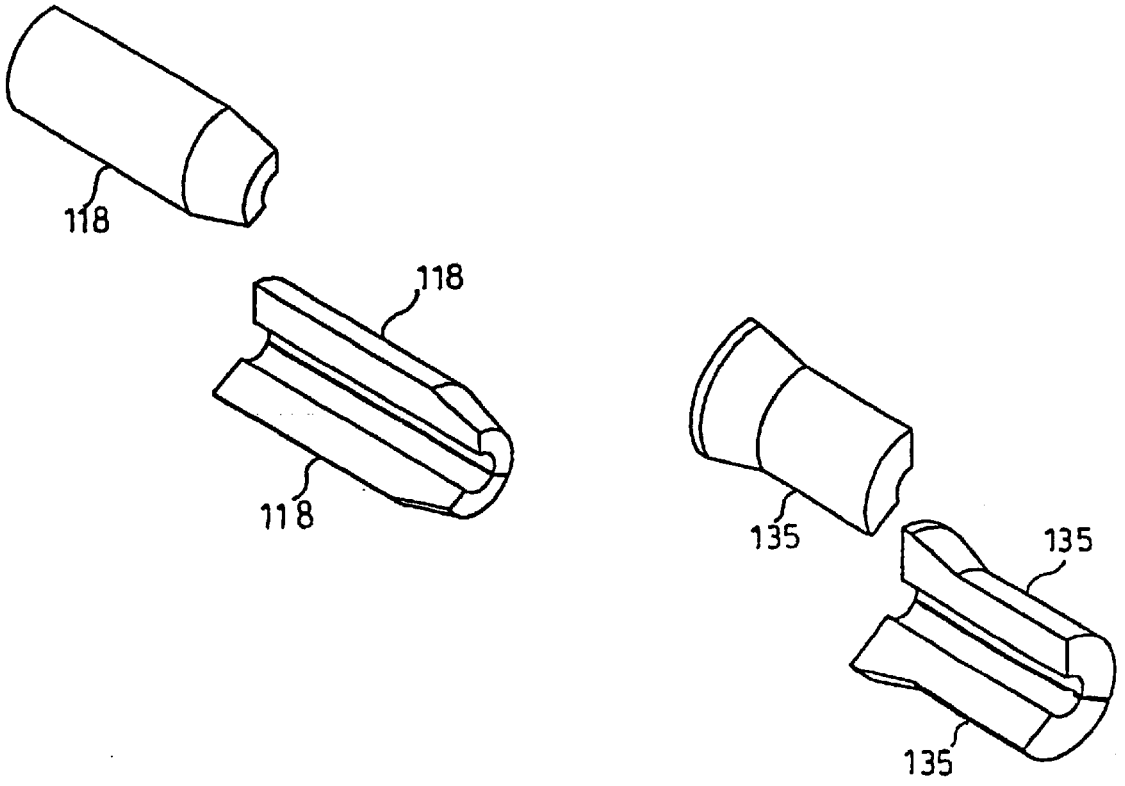
FIG. 13 is a side view of a modified version of chucks incorporated in the apparatus shown in FIG. 6.

The number of split chuck 118 pieces can be two as shown in FIG. 12 or three as shown in FIG. 13.

The pressing device 109, provided in the rear end of the driven rotary section 105 to push the driven rotary section 105 toward the driver rotary section 103 by means of a hydraulic cylinder 136 provided on the rotary framework 107. The hydraulic cylinder 136, designed to push the holder 134 toward the driver rotary section 103, has a piston rod 136*a* engaged with an inner bearing 137 around which an outer bearing 138 is provided in engagement with the inner sleeve 134, so as to avoid transmitting the rotation of the inner sleeve 134 to the piston rod 136*a*. As alternatives of the pressing device 109, a hydraulic jack or a fluid cylinder can be employed.

No controller for the motors 122, 128, 131 and the hydraulic cylinder 136 is illustrated in the drawings, but it can be designed to optionally set the rotations per minute of each motor and a pressure provided by the cylinder. The angle of the biasing device can be adjusted as desired.

Instead of constructing the biasing device such that it rotates the work in a horizontal plane, the rotary pivot is constructed such that it vertically rotates around the horizontal axis perpendicular to the work (W), thereby enabling an operator to inspect the state of the diametral expansion in progress from the side of the apparatus.

Figure 14:
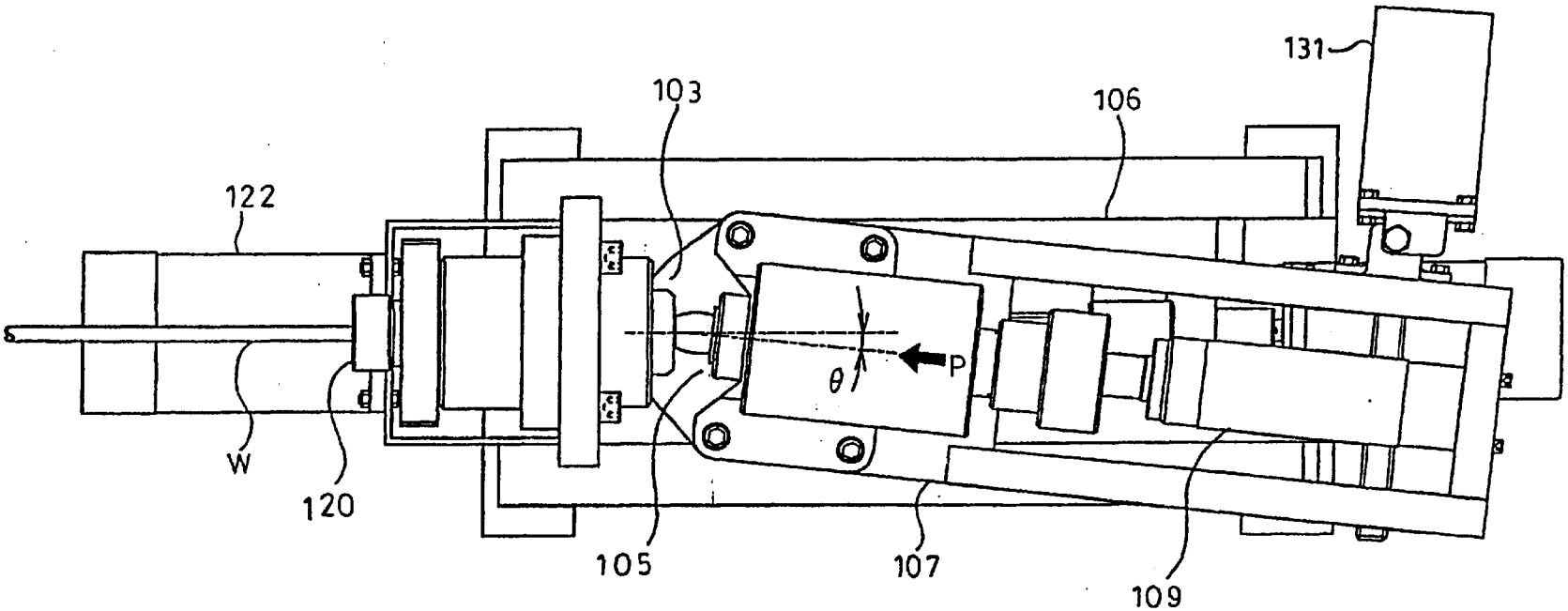
FIG. 14 is a schematic view of the apparatus shown in FIG. 6 when it is in the process of performing the diametral expansion.

In making a desired local diametral expansion by using the apparatus 101, the driver rotary section 103 and the driven rotary section 105 are arranged such that the inner sleeves 117 and 134 are aligned. The work (W) is inserted between the chucks 118 opened by loosening the hollow bolt 120 to expand the chucks 118. Then the target portion for the local diametral expansion is specified by placing that portion flush with the end face of the chucks, followed by fastening the bolt 120 to hold the work (W) in the chucks 118. Then, the feeder 124 is operated to move the driven rotary section 105 toward the driver rotary section 103, and allows the work (W) to become held by its chucks 135, wherein the driver rotary section 103 and the driven rotary section 195 are appropriately spaced. Then the motor 112 is operated to rotate the inner sleeve 117, thereby causing the work (W) held by the chucks 118 to rotate. The driven chucks 135 are also rotated. The work (W) is axially pressed by the pressing device 109, and the driven rotary section 105 becomes biased by the biasing device 108 as shown in FIG. 14. In this way, when both the pressing device 109 and the biasing device 108 are put into operation, the work (W) held by the chucks 118 and 135 are rotated and compressed in its bent position. The rotating speed can be a few tens of times per minute, and the bending angle θ can be $3^{0}$ to $7^{0}$. The amplitude of pressure depends upon the diameter of the work. In general, a local diametral expansion is possible with a pressure equal to about 20% to 30% of the stress at which a single metal shaft reaches a yield point as taught in Technical Reports entitled "Study on Diametral Expansion of a Bar" (Vol. 34 by Nih'hama Technical Academy).

Figure 15:
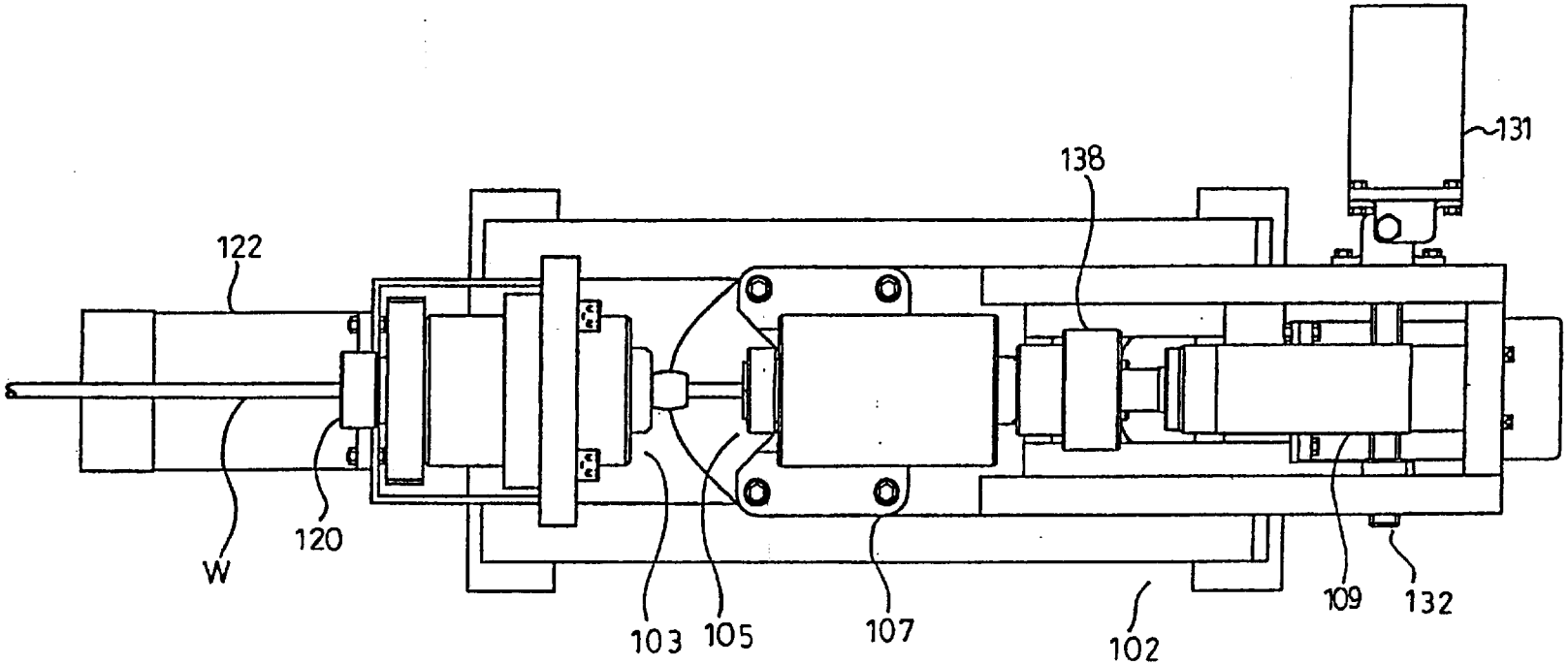
FIG. 15 is a plan view of the apparatus shown in FIG. 6 when the process is finished.
Figure 16:
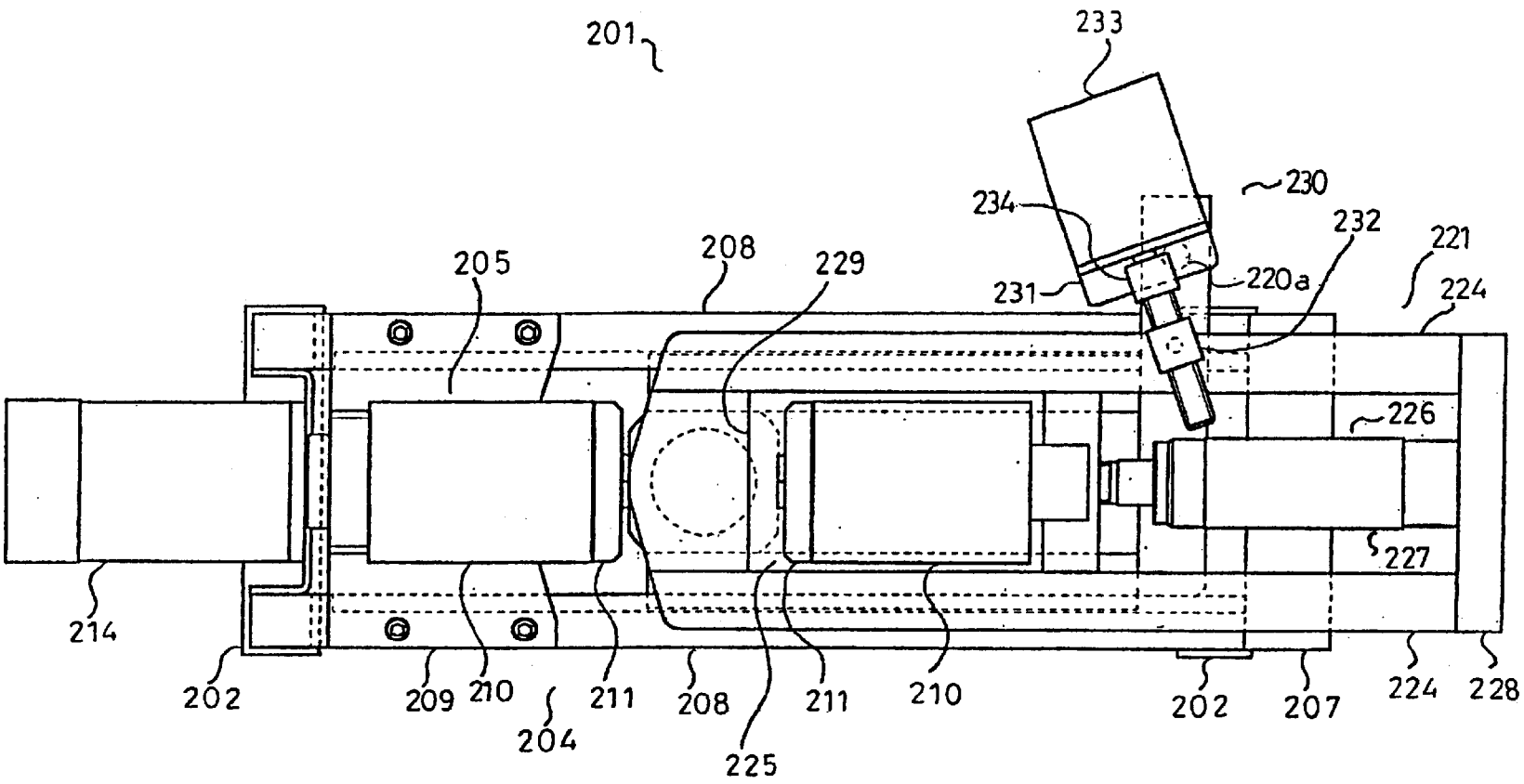
FIG. 16 is a plan view of an apparatus according to a further embodiment of the invention.
Figure 17:
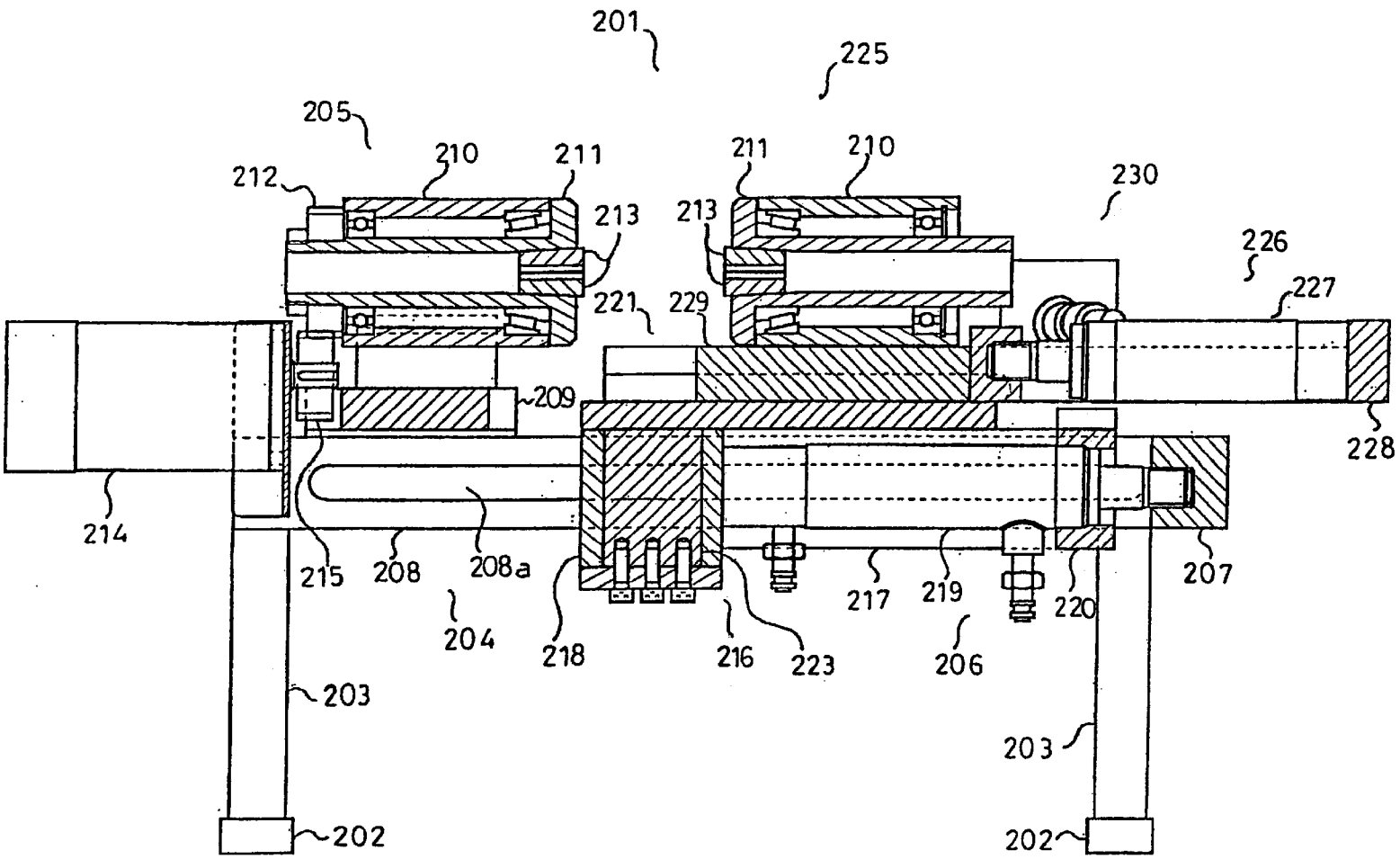
FIG. 17 is a cross-sectional side view of the apparatus shown in FIG. 16.
Figure 18:
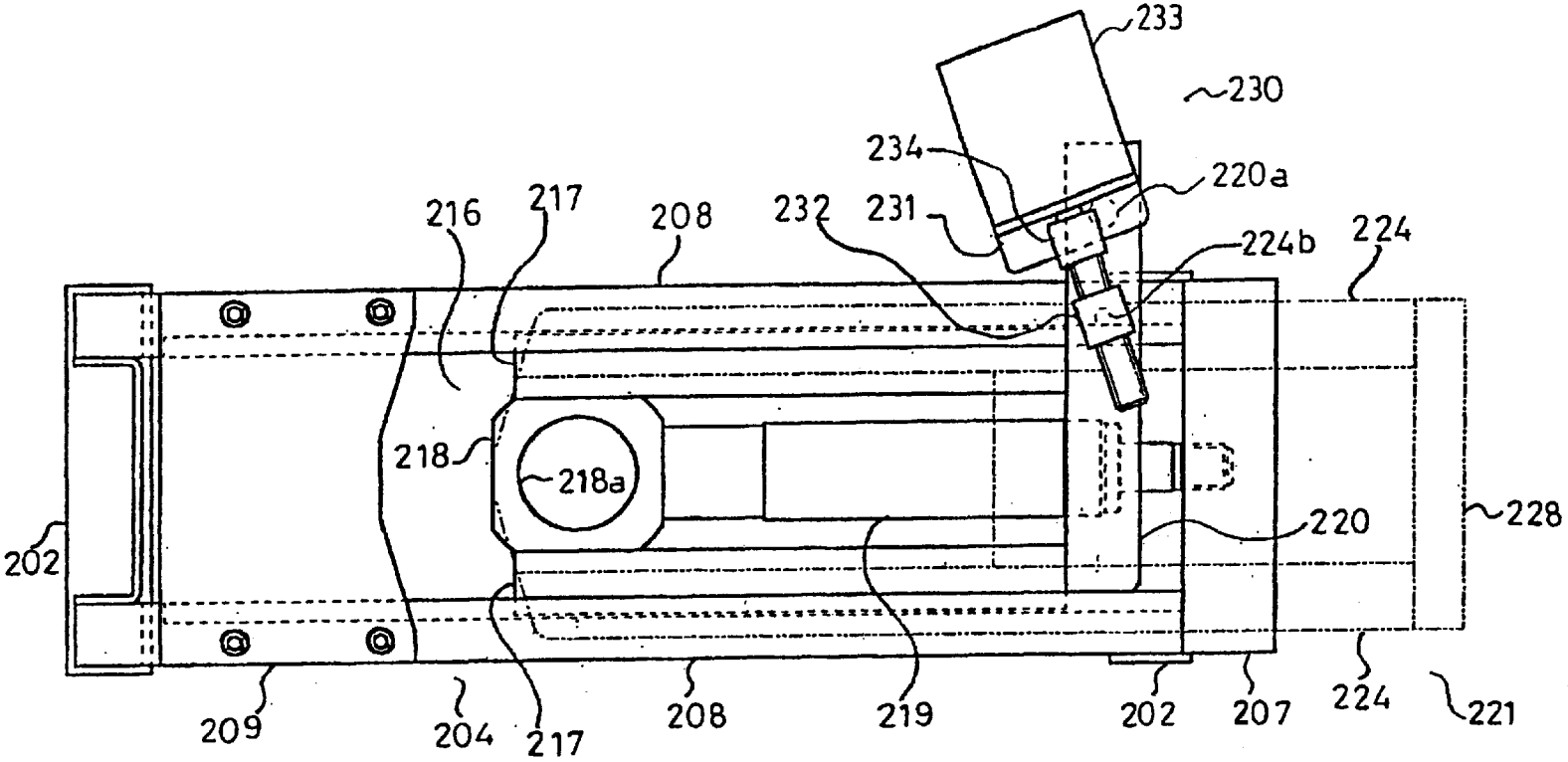
FIG. 18 is a plan view of a slidable framework and a rotary framework (shown in imaginary lines) incorporated in the apparatus shown in FIG. 16.
Figure 19:
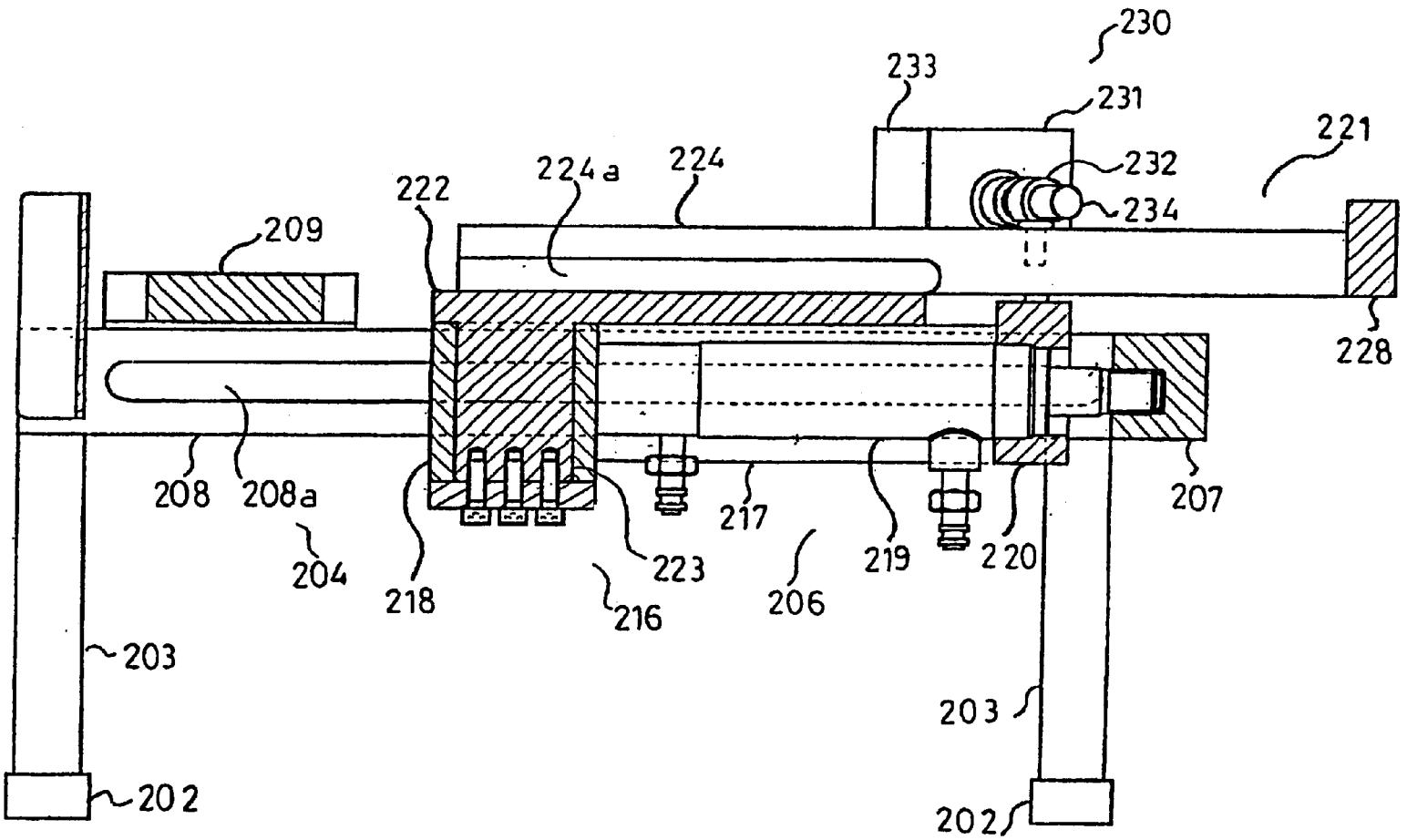
FIG. 19 is a cross-sectional side view of the arrangement shown in FIG. 18.

In this way the work (W) is subjected to rotation, bending, and pressuring between the chucks 118 and 135, thereby effecting a local diametral expansion of this part of the work. As the local diametral expansion advances, the distance between the chucks 118 and 135 becomes short while the work is constantly subjected to pressuring. If the pressure is reduced at this moment, the outside and the inside around the bent portion are alternately subjected to bending and straightening, thereby resulting in the breakdown of the work (W). After the desired local diametral expansion is finished, the biasing device 108 is returned to its original position (i.e. where the rotary sections 103 and 105 are aligned) while the rotation and pressuring are repeated. As a result, the work (W) having a diametrically expanded portion is obtained as shown in FIG. 15. Finally, the rotation and compression are stopped, and the work (W) is taken out of the chucks 135.

FIGS. 16 to 22 show a further preferred embodiment of the present invention. The illustrated apparatus 201 is provided with a stand 202 on a floor on which pillars 203 are erected to support a rectangular framework 204. A driving rotary section 205 is mounted on the front part of the framework 204 (the left-hand part in FIG. 16), and a mount 207 for a slidable pressing device 206 is fixed to the rear part of the framework 204. The framework 204 includes grooves 208*a* on opposite side 208.

The driven rotary section 205 includes a cylindrical sleeve 211 rotatably supported on a sleeve body 210 secured to a member 209 of the framework 204, the sleeve 211 being provided with a follower gear 212. The sleeve 211 houses chucks 213 designed to hold a work (W). The sleeve 211 and the chucks 213 are provided with tapered portions for the same reason referred to above.

A motor 214 is provided in a lower part of the sleeve 211 as a power source for rotating the work (W), having an output shaft being provided with a gear 215 engaged with the follower gear 212.

A slidable framework 216 moves toward and away from the driving rotary section 205, as the case may be. The framework 216 is substantially rectangular, and its side frames 217 are provided with projections to be fitted in the groove 208*a* of the frame 204. Between the side frames 217 is provided an intermediate member 218 with an inside space 218*a*. The frame 204 is slid by a double-acting hydraulic cylinder 219 provided between the mount 207 and the intermediate member 218. The hydraulic cylinder 219 is supported by a holder 220 secured to the slidable framework 216. The contraction and expansion of the hydraulic cylinder 219 cause the framework 216 to move to and fro along the length of the apparatus 201.

On top of the framework 216 is a rotary framework 221, which secures a pair of rails 224 provided with a groove 224. The rails 224 are provided with a hydraulic cylinder 227 at their rear ends through a mount 228, which functions as a pressing device 226 for a driven rotary section 225, hereinafter referred to. The rotary framework 221 is rotatably connected to the slidable framework 216.

The driven rotary section 225 is located opposite the driving rotary section 205 on the framework 221. The driven rotary section 225 has the same construction as the driving rotary section 205, wherein like reference numerals denote like components. The sleeve 210 of the driven rotary section 225 is slidable along the rails 224 on the framework 221 through engagement of a projection of a member 229 in the grooves 224*a*. A hydraulic cylinder 227 as the pressing device 226 is provided. The contraction and expansion of the cylinder 227 causes the driven rotary section 225 to move to and fro along the length of the apparatus.

In this embodiment the hydraulic cylinder is employed for a pressing device but instead of it, a screw type feed system can be used.

The reference numeral 230 denotes a biasing device 230 which includes a member 231 rotatably fitted in an inside space 220*a* of the holder 220 in the framework 216, ad a nut 22 rotatable in an inside space 224*b* produced in the rails 224 with the additional provision of a motor 233 whose output shaft is provided with a male thread portion 234 engaged with the nut 232. The rotation of the motor 233 in either direction causes the male thread portion 234 to rotate, followed by the movement of the nut 232. In this way the rotary framework 221 is rotated around a pivot 223, thereby causing the driven rotary section 225 on the rotary framework 221 to rotate.

No controller is illustrated in the drawings for the motors 214 and 233 and the hydraulic cylinder 219, 227. However, these motors 214, 233 are designed to control their clockwise or anti-clockwise rotations on their own, and the hydraulic cylinders 219, 227 to control the amount of their movement on their own.

In this embodiment the work (W) is rotated through the driving rotary section 205 driven by the motor 214. The driven rotary section 225 is caused to move toward and away from the driving rotary section while being biased by the biasing device 230 with respect to the axis of the driving rotary section 205. When the pivot 223 approaches the driving rotary section 205, the driven rotary section 225 is caused to approach the pivot 223 by the second pressing device 226. This means that the axis of the pivot 223 can be appropriately located between the two chucks 213 of the holders 205 and 225 by adjusting the sliding distance of the pressing devices 206 and 226.

In this embodiment the operation of the apparatus 201 is initiated by aligning the two rotary sections 205 and 225. Then, the work (W) is inserted between the chucks 213 in the holders 205 and 225. The motor 214 is energized to rotate the work (W). The pressing devices 206 and 226 are operated to compress the work (W), and biasing device 230 is operated to bend it, wherein the compressive force is such that no pull occurs around the bent portion or at least a load to the work (W). If the compressive force is weak, the work (W) is subjected to repeated compression and extension, and is finally liable to fracture. A desired local diametral expansion of the work (W) is finished, the rotary sections 205 and 225 are aligned by the biasing device 230 while the compression and rotation are continued so as to straighten up the work. Finally, the work (W) is taken out of the holders 213 by contracting either of the pressing device 206 or 226.

Figure 20:
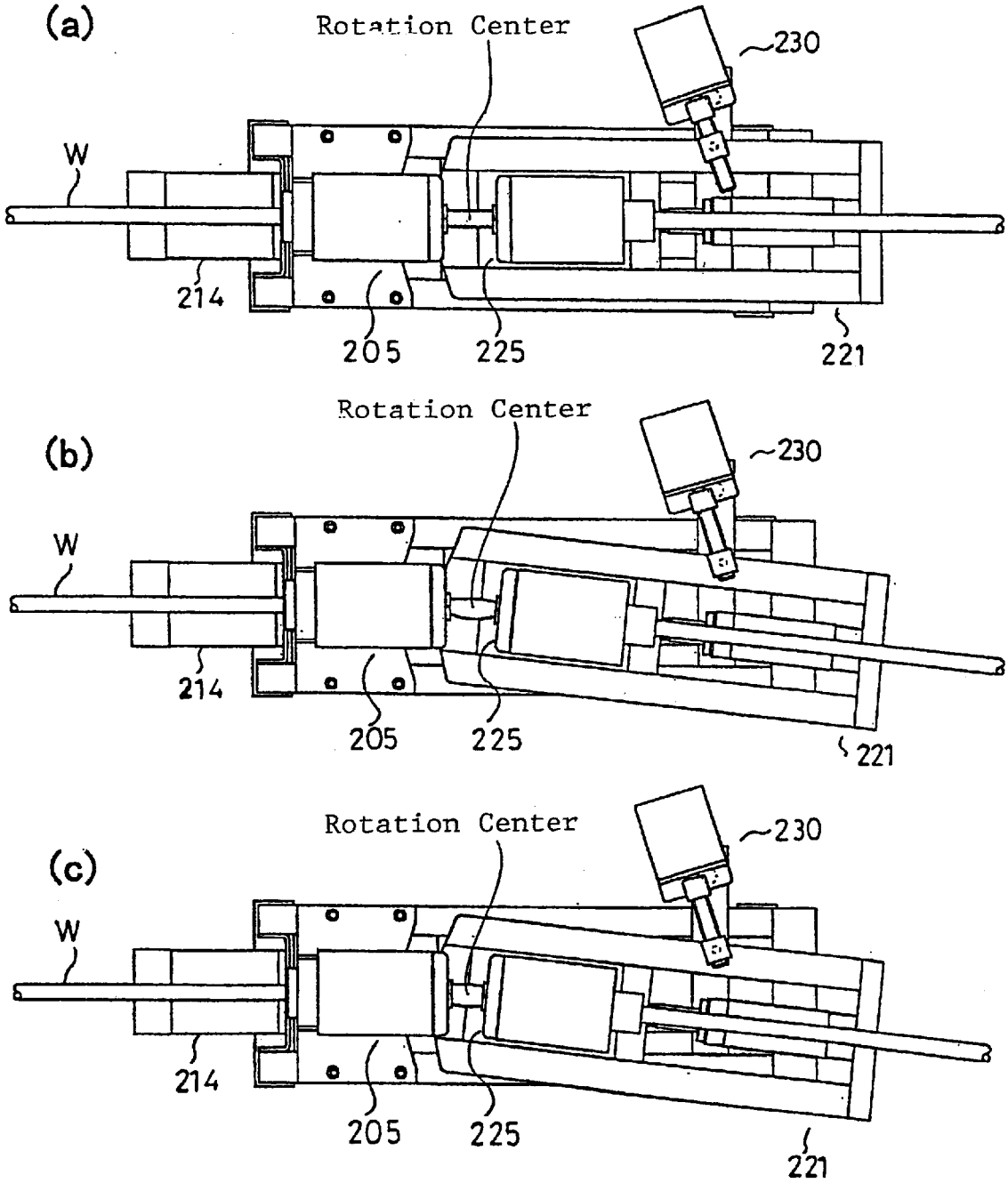
FIGS. 20*a*–20*c* are a schematic view explaining the process of performing the diametral expansion according to the embodiment shown in FIG. 16.

As shown in FIG. 20, the driven rotary section 225 approaches the driving rotary section 205 by the pressing device 206 which causes the framework 216 to approach the driving rotary section 205. Furthermore, the driven rotary section 225 approaches the pivot 223 by the framework 221 by the pressing device 226. This means that the approach of the driven rotary section 225 to the pivot 223 causes the driven rotary section 225 to approach the pivot 223. In this way the axis of the pivot 223 as the point of bend is located in the middle between the chucks 213. This ensures that the local diametral expansion of the work occurs in the middle between the chucks 213. This prevents the loss of the expanding force.

Figure 21:
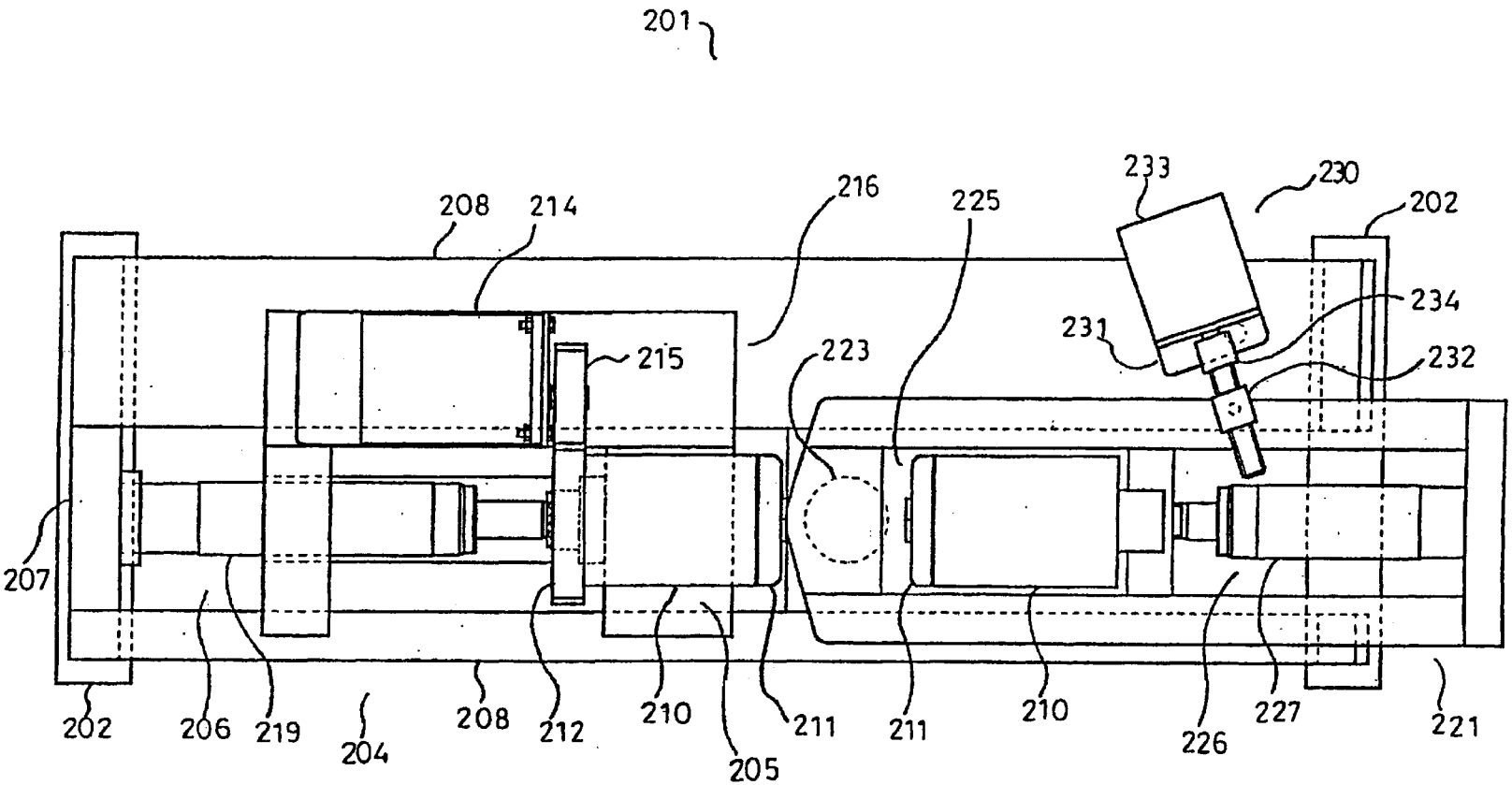
FIG. 21 is a plan view of a still further embodiment of the invention.
Figure 22:
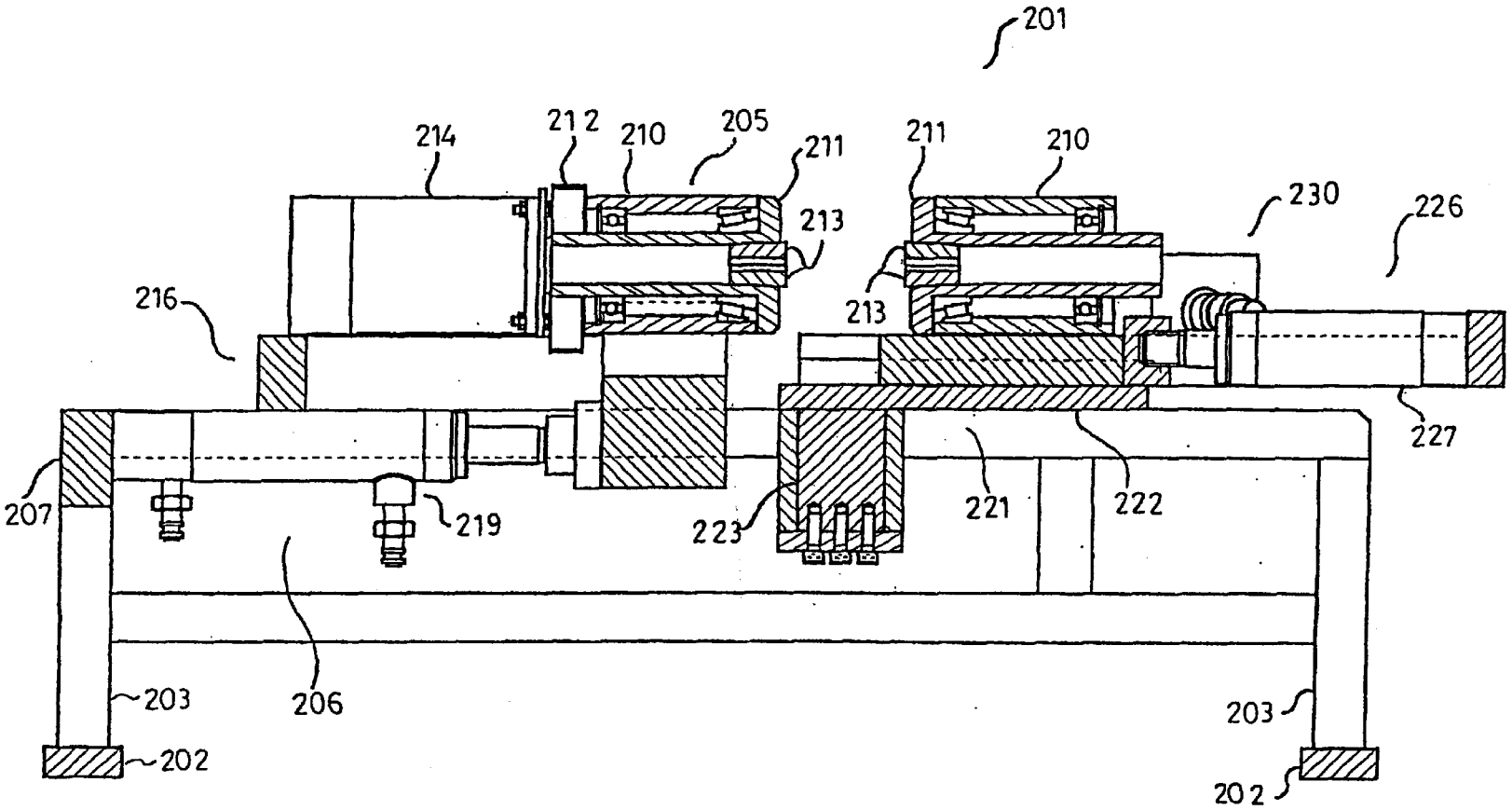
FIG. 22 is a cross-sectional side view of the apparatus shown in FIG. 21.
Figure 23:
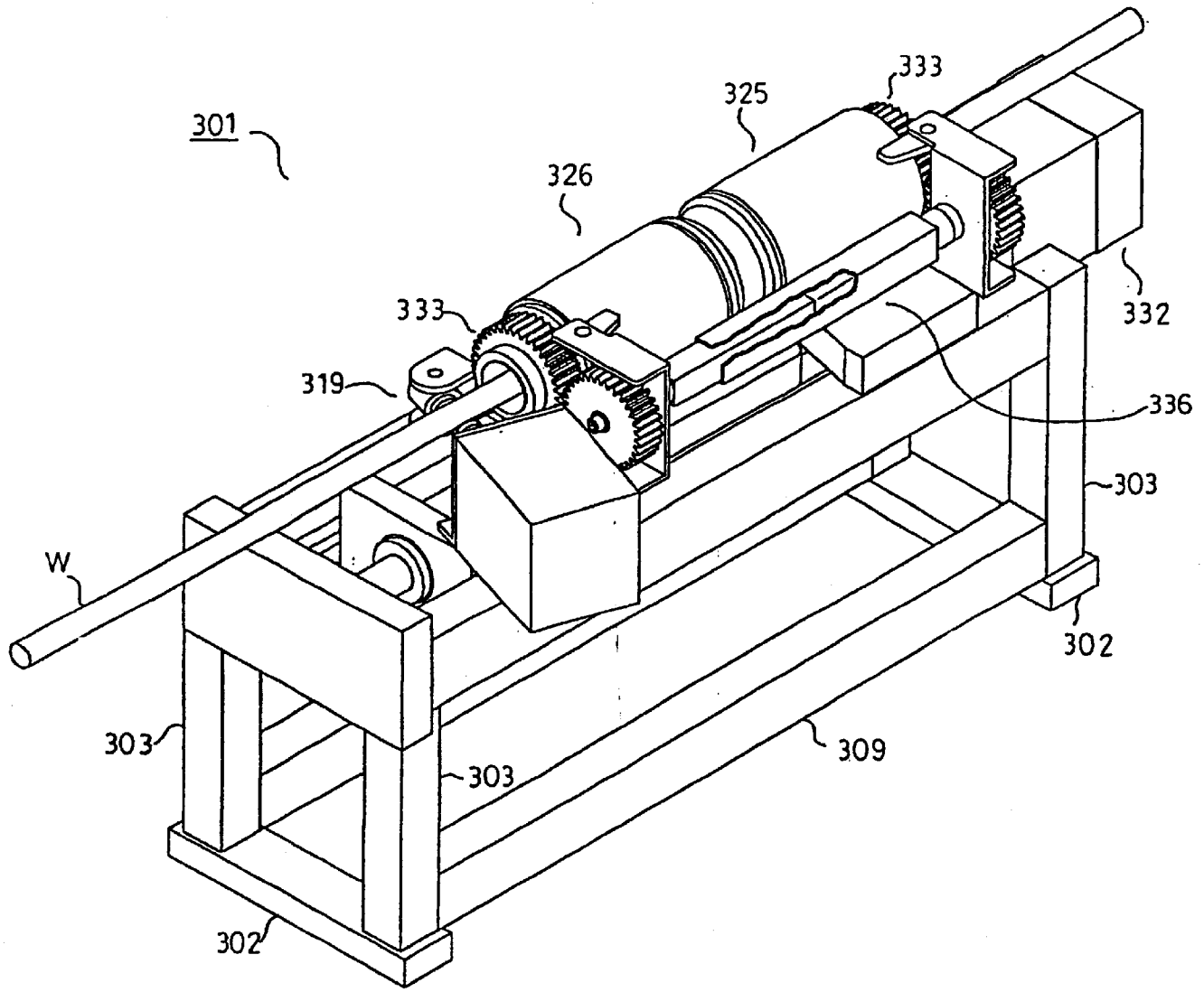
FIG. 23 is a perspective view of another embodiment of the invention.
Figure 24:
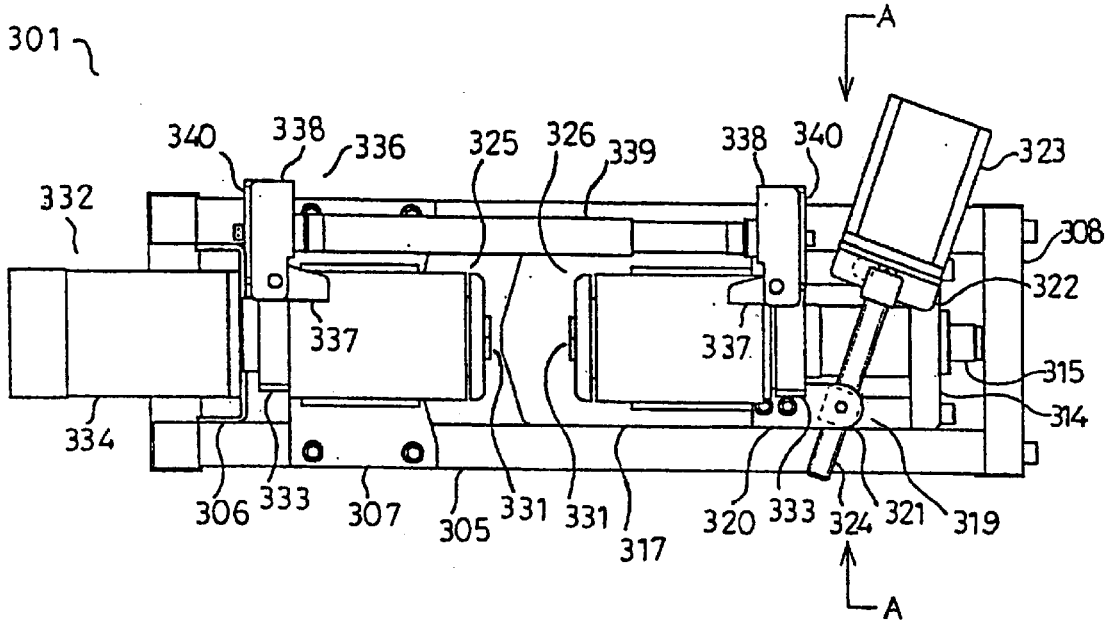
FIG. 24 is a plan view of the apparatus shown in FIG. 23.
Figure 25:
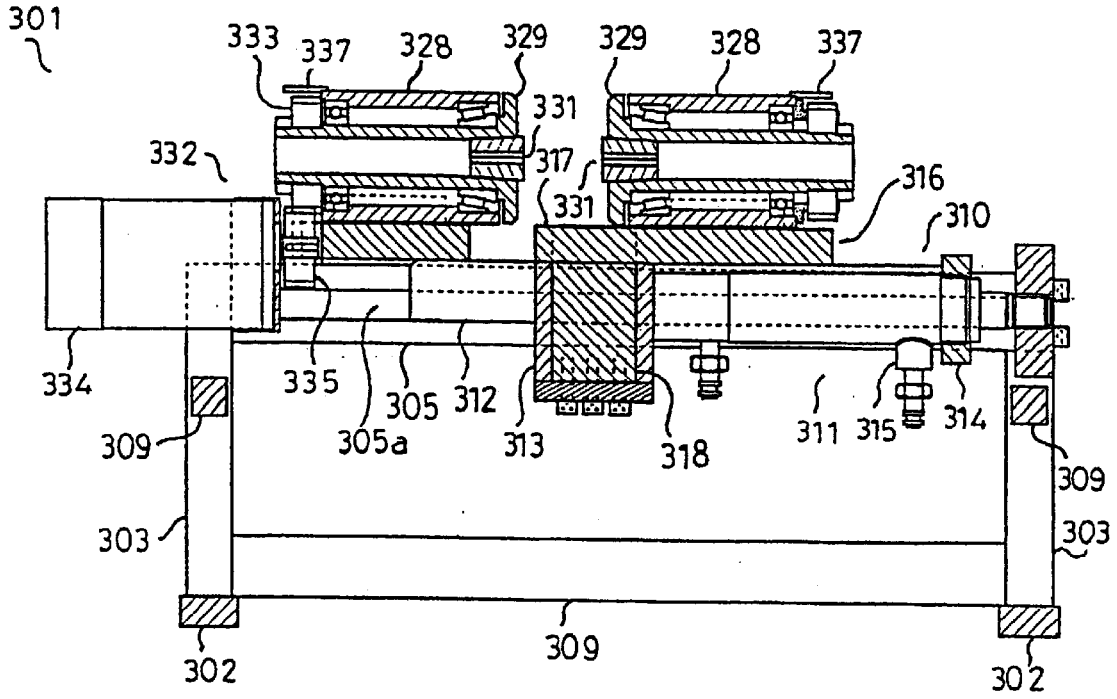
FIG. 25 is a cross-sectional side view of the apparatus shown in FIG. 23.
Figure 26:
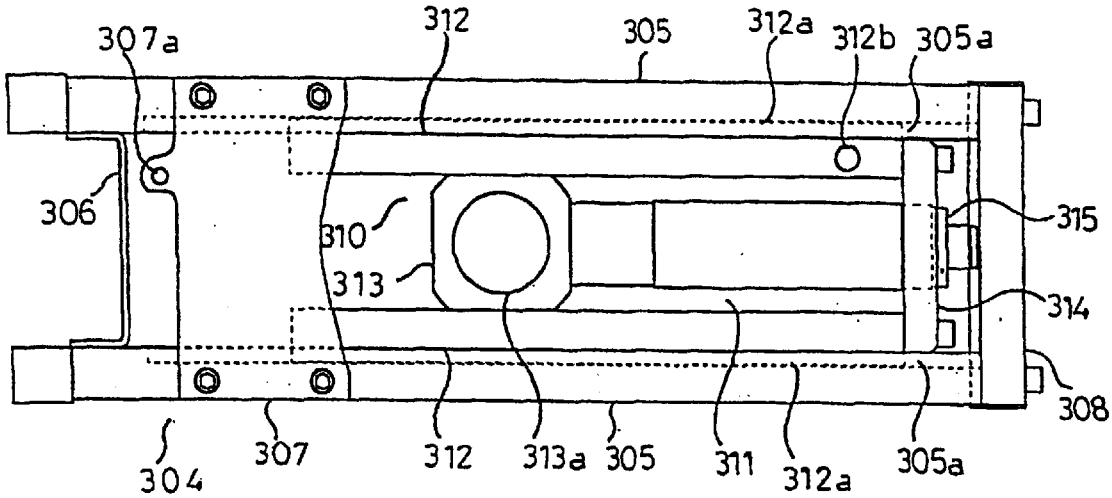
FIG. 26 is a plan view of a slidable framework and a sliding device incorporated in the apparatus shown in FIG. 23.
Figure 27:
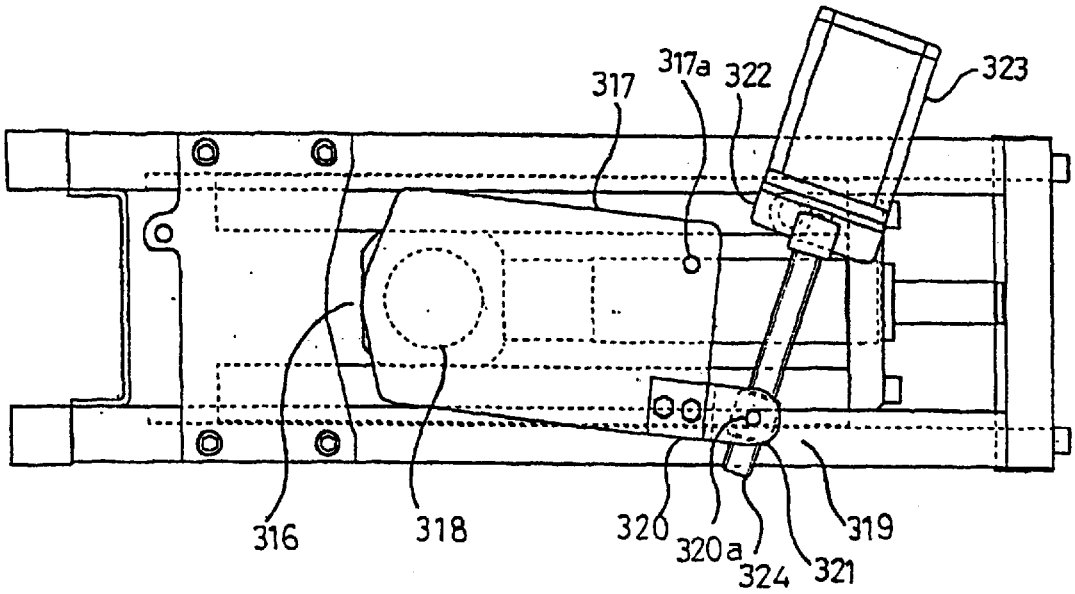
FIG. 27 is a plan view of a rotary frame and a biasing device incorporated in the apparatus shown in FIG. 23.
Figure 28:
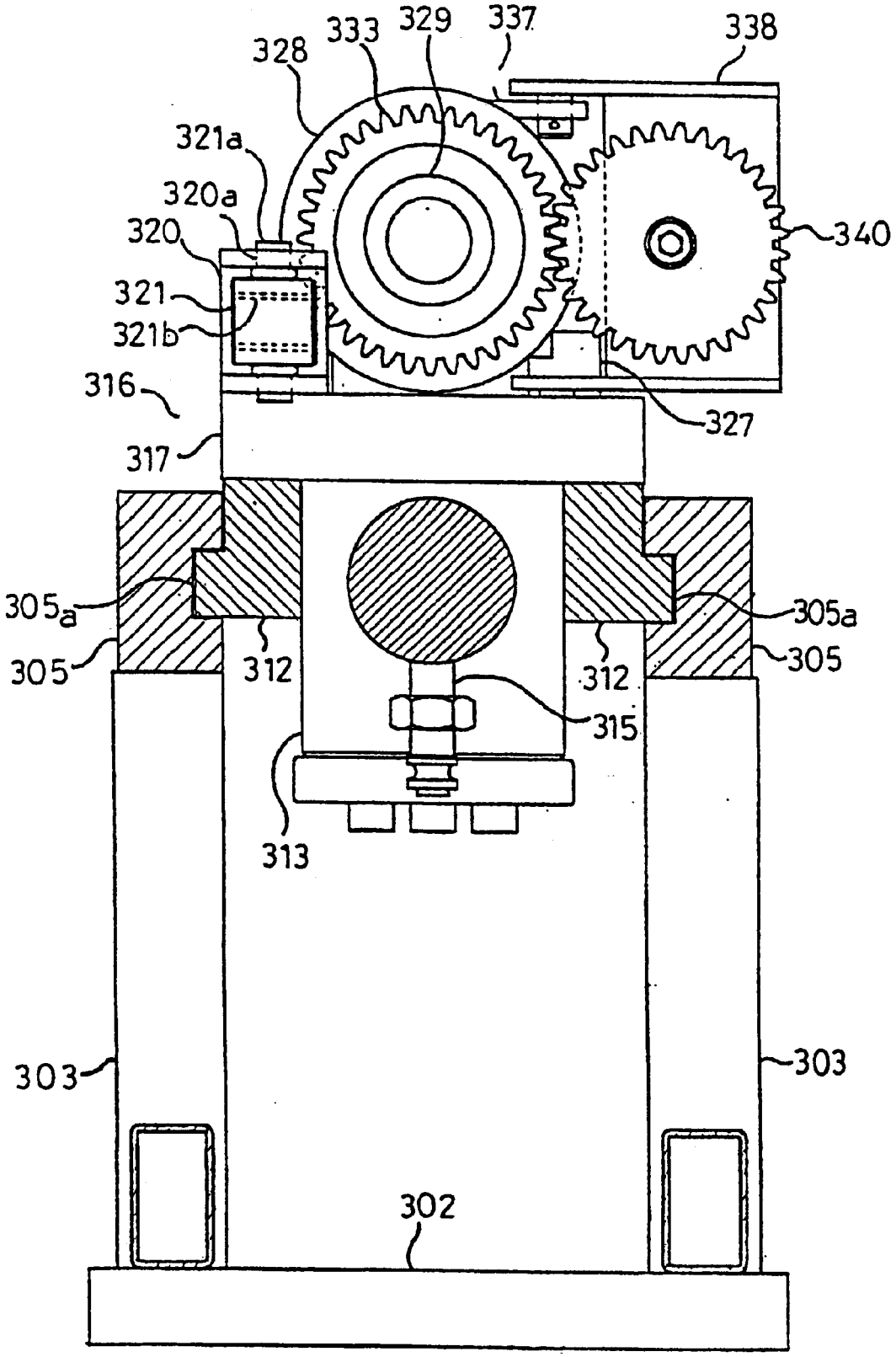
FIG. 28 is a cross-sectional view taken along the line A—A in FIG. 24.
Figure 29:
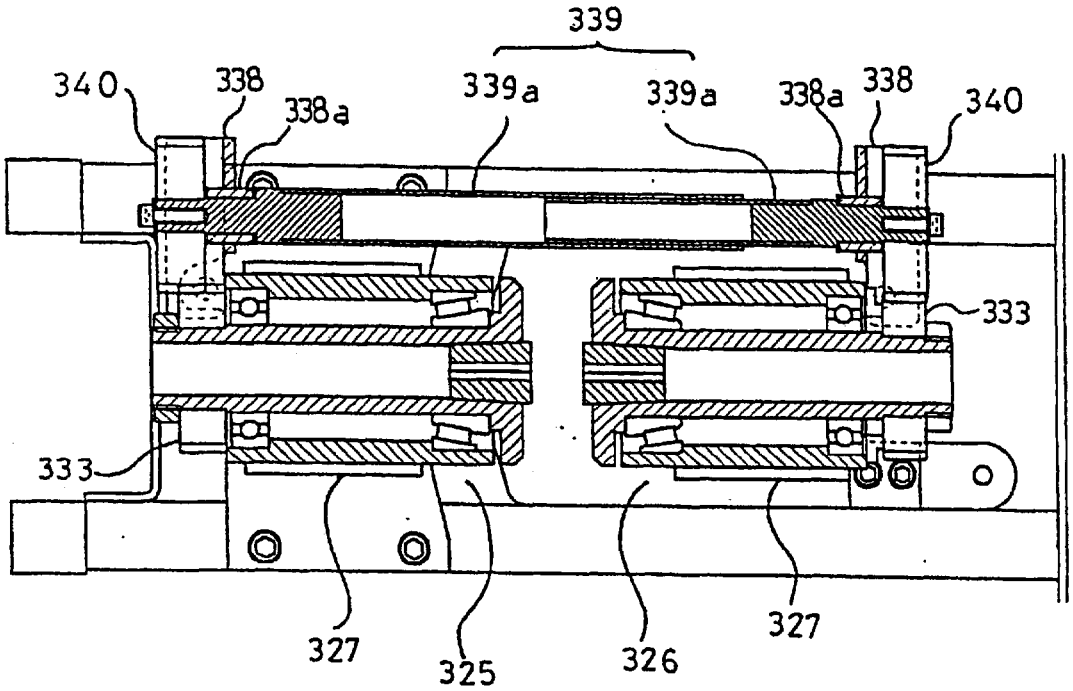
FIG. 29 is a cross-sectional view of a transmission incorporated in the apparatus shown in FIG. 23.

FIGS. 21 and 22 show a further preferred embodiment, where, instead of the driving rotary section 205 secured to the framework 204, the intermediate member 218 for the pivot 223 is secured to the framework 204, and the framework 221 is rotatably connected to the intermediate member 218. In addition, the driven rotary section 225 is arranged to move toward and away from the pivot 223 on the rotary framework 221, and the slidable framework 216 is constructed to move toward and away from the pivot 223 along the sides 208 of the framework 204, and the driving rotary section is secured to the slidable framework 216. In this embodiment the axis of the pivot 223 is adequately located between the chucks 213 by adjusting a distance over which the pressing devices 206 and 226 have slid. FIGS. 21 and 22 like reference numerals designate like elements and components to those of the above-mentioned embodiments, and therefore, a description will be omitted for simplicity.

When the sliding distances of the pressing devices 206 and 226 are equalized, the axis of the pivot as the point of bend is advantageously located in the middle between the chucks 213 for effecting a diametral expansion of a metal shaft.

FIGS. 23 to 29 show a still further preferred embodiment. The illustrated apparatus 301 is provided with stands 302 on which pillars 303 are erected to support a rectangular framework 304. A groove 305*a* is provided between the opposite sides 305 of the framework 304 along the length of the apparatus 301. The framework 304 is provided with a motor mount 306 and a front bracket 307 in its front section, and a rear bracket 308 in its rear section. The reference numerals 309 designate reinforcements.

Between the sides 305 are arranged a slidable framework 310 and a sliding device 311 for causing the framework 310 to slide along the length of the apparatus 301. The slidable framework 310 includes side frames 312 having a projection 312*a* fitted in the groove 305*a,* and an intermediate member 313 having an opening 313*a* vertically formed and a support 314 for the sliding device 311. The sliding device 311 is provided in the form of a double-acting hydraulic cylinder 315 on the side of the intermediate member 313. The hydraulic cylinder 315 is supported by the support 314, and is secured to the rear bracket 308. In this way the extension and contraction of the hydraulic cylinder 315 cause the slidable framework 310 to slide along the length of the apparatus 301. The hydraulic cylinder 315 can be substituted by other suitable means such as a screw-base system feeder.

A rotary framework 316 is carried on the slidable framework 310. The rotary framework 316 includes a plate member 317, and a rotary pivot 318 rotatably fitted in the inside space 313*a*. A biasing device 319 is provided in a rear section of the rotary framework 316. The biasing device 319 includes a plate 320 in which inside spaces 320*a* are produced to accept shafts 321*a,* with a feed nut 321 having a female thread 321*b* inside.

The slidable framework 310 includes an inside space 312*b* in its sides 312 in which a mount 322 is provided on which a motor 323 is mounted. The motor 323 has an output shaft is provided with a male thread 324 engaged with the feed nut 321. In this way the rotation of the motor 323 in either direction causes the feeder nut 321 to move toward and away from the motor 323 whereby the rotary framework 316 is rotated around the pivot 318.

Rotors 325 and 326 are aligned on the front bracket 307 and the plate member 317. Each of the rotors 325 and 326 includes a rotable inner sleeve 329 in an outer sleeve 328. The inner sleeve 329 is provided with the tapered portion on the inside wall with which chucks 331 are engaged. The chucks 331 are formed by splitting a sleeve member having a tapered portion matching with that of the inner sleeve 329 into several chuck pieces.

A driving device 332 is provided to drive a holder 330 of the rotor 325, the driving device including a follower gear 333 in the inner sleeve 329. The inner sleeve 329 of the other rotor 326 has a similar follower gear 333. There is provided a motor 334 whose output shaft is provided with a driving gear 335 engageable with the follower gear 333 so as to transmit a torque to the rotor 325. The torque transmitted to the follower gear 333 is transmitted to the rotor 326 through a transmission 336, which includes metals 337 secured to the outer sleeves 328, and brackets 338 rotatably fitted in an inside space 307*a* produced in a front framework 307 of a framework 304 and an inside space 317*a* in the plate member 317 of the rotary framework 316. The bracket 338 is provided with bearings 338*b* which carry a pair of splines 339 having teeth 340 engaged with the follower gears 333. The transmission 336 transmits a torque of the rotor 326 to the other rotor 325 as the former moves in either direction or is biased, through engagement of the follower gears 333 and gears 340.

No controller for the hydraulic cylinder 315, the motors 323 of the biasing device 319, and the motor 332 for driving the apparatus is illustrated in the drawings but any other controlling means can be employed singly or in combination if it can start and stop them as desired.

Figure 30:
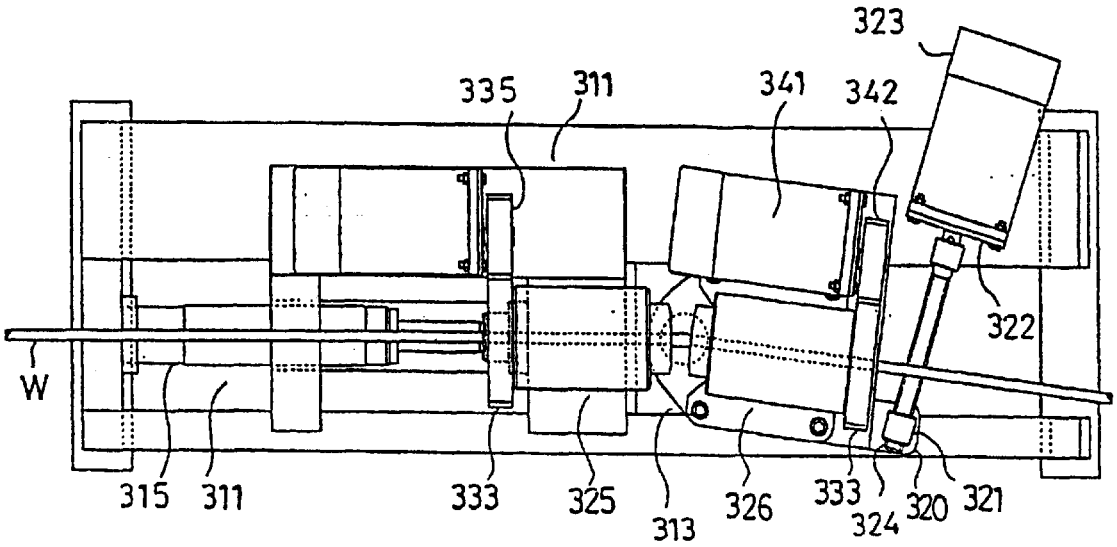
FIG. 30 is a plan view of an apparatus according to a further embodiment of the invention.
Figure 32:
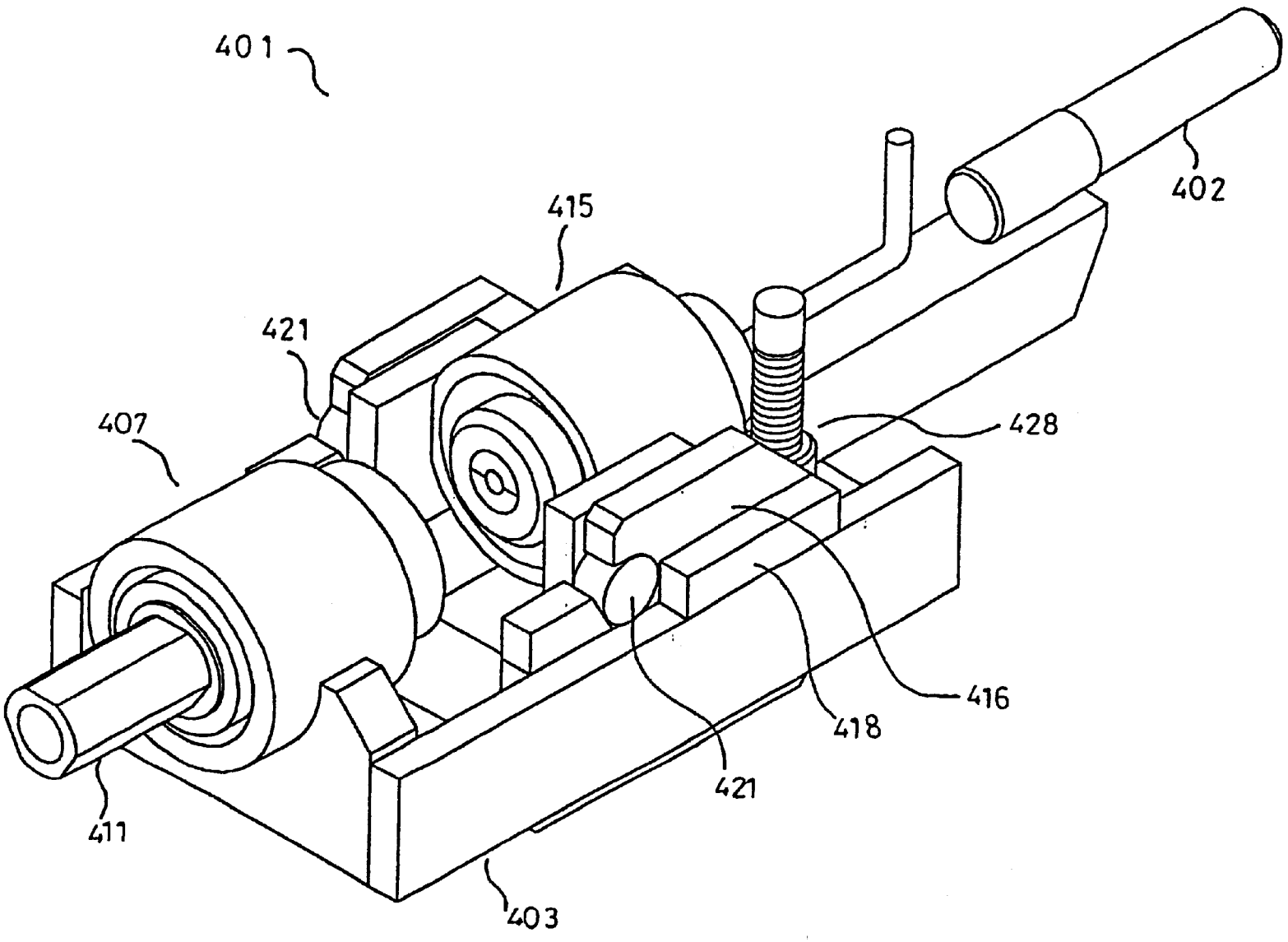
FIG. 32 is a perspective view of an apparatus according to a still further embodiment of the invention.
Figure 33:
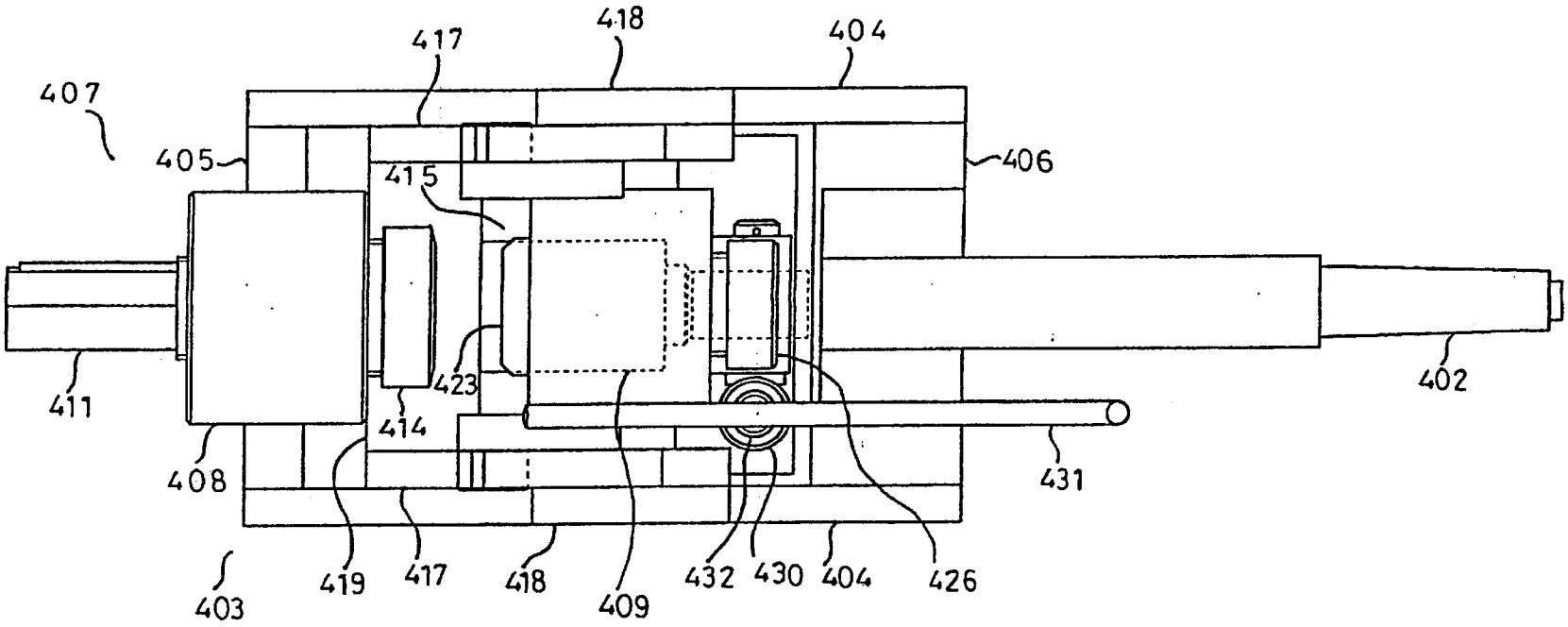
FIG. 33 is a plan view of the apparatus shown in FIG. 32.
Figure 34:
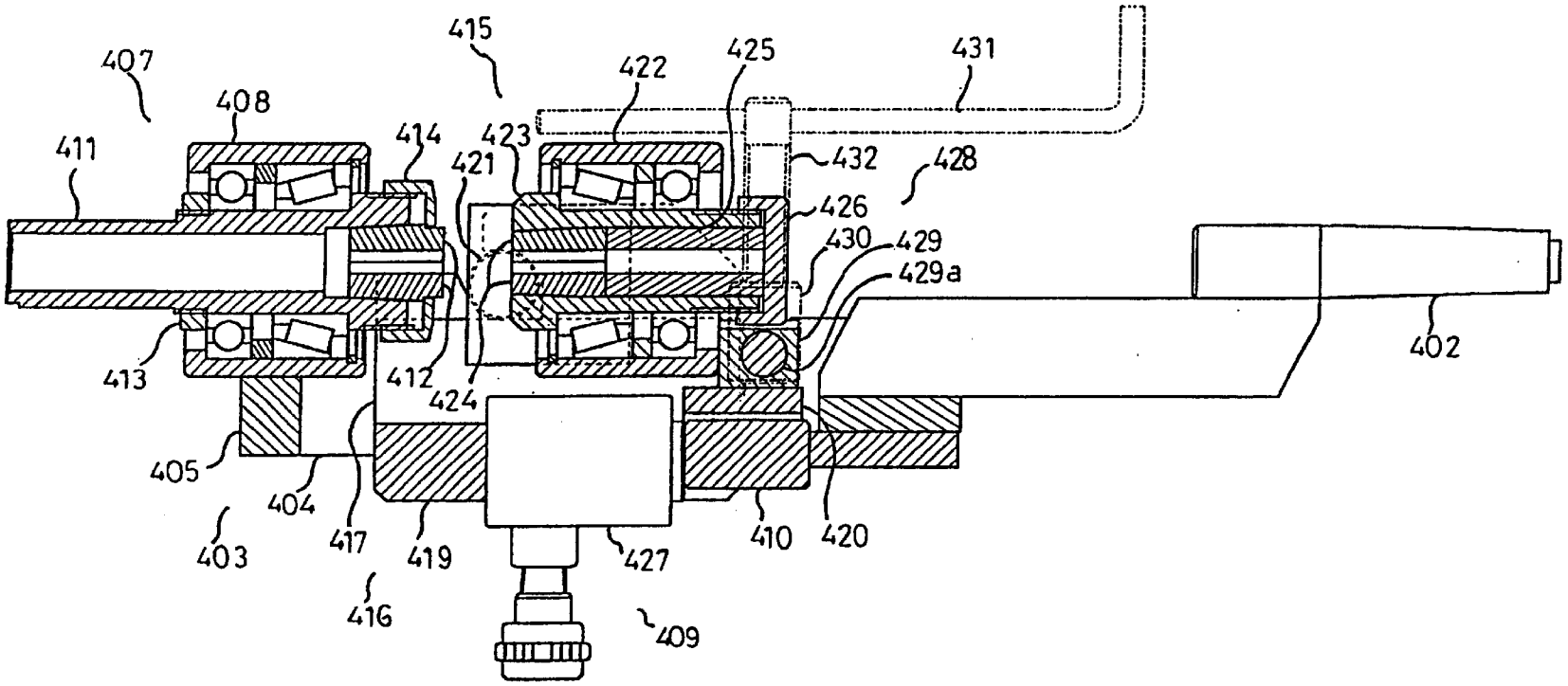
FIG. 34 is a cross-sectional side view of the apparatus shown in FIG. 32.
Figure 35:
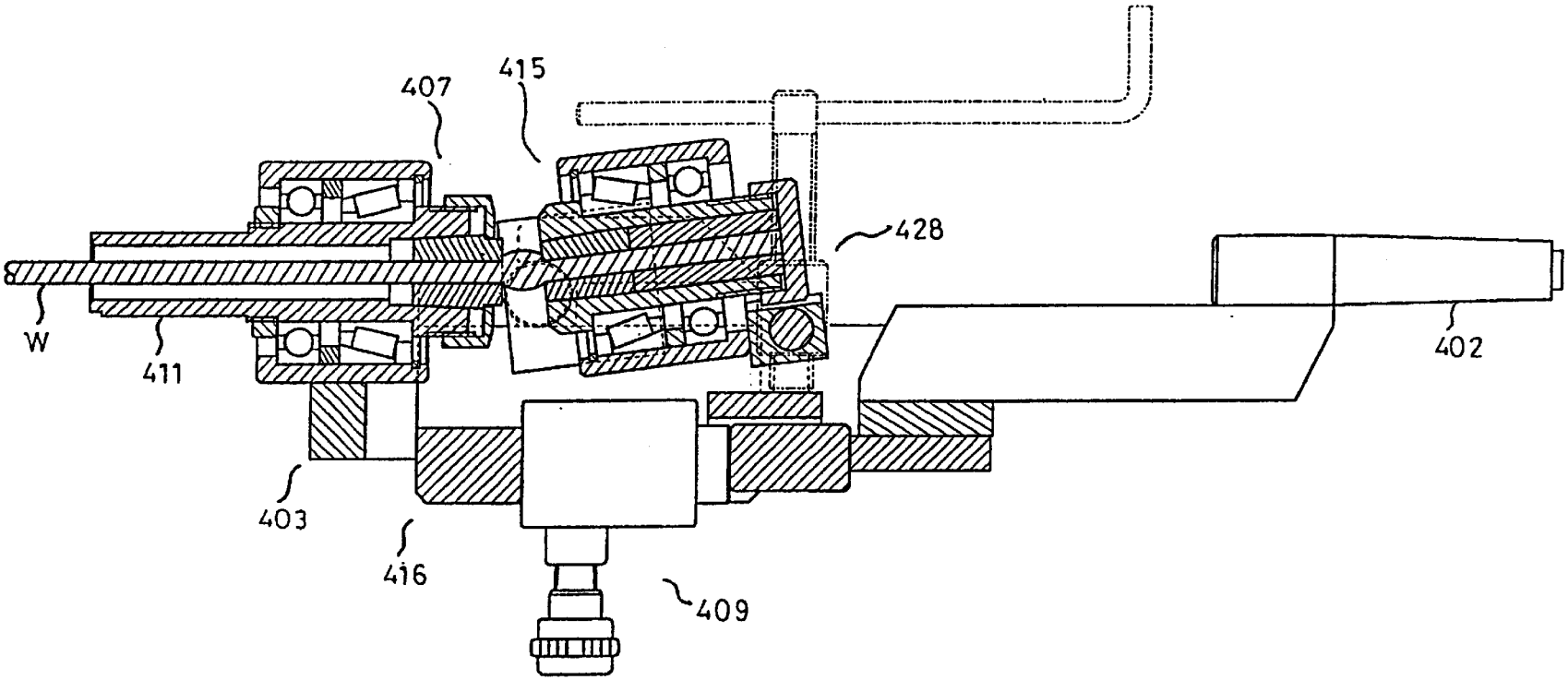
FIG. 35 is a cross-sectional side view explaining the process of performing the diametral expansion according to the embodiment shown in FIG. 32.
Figure 36:
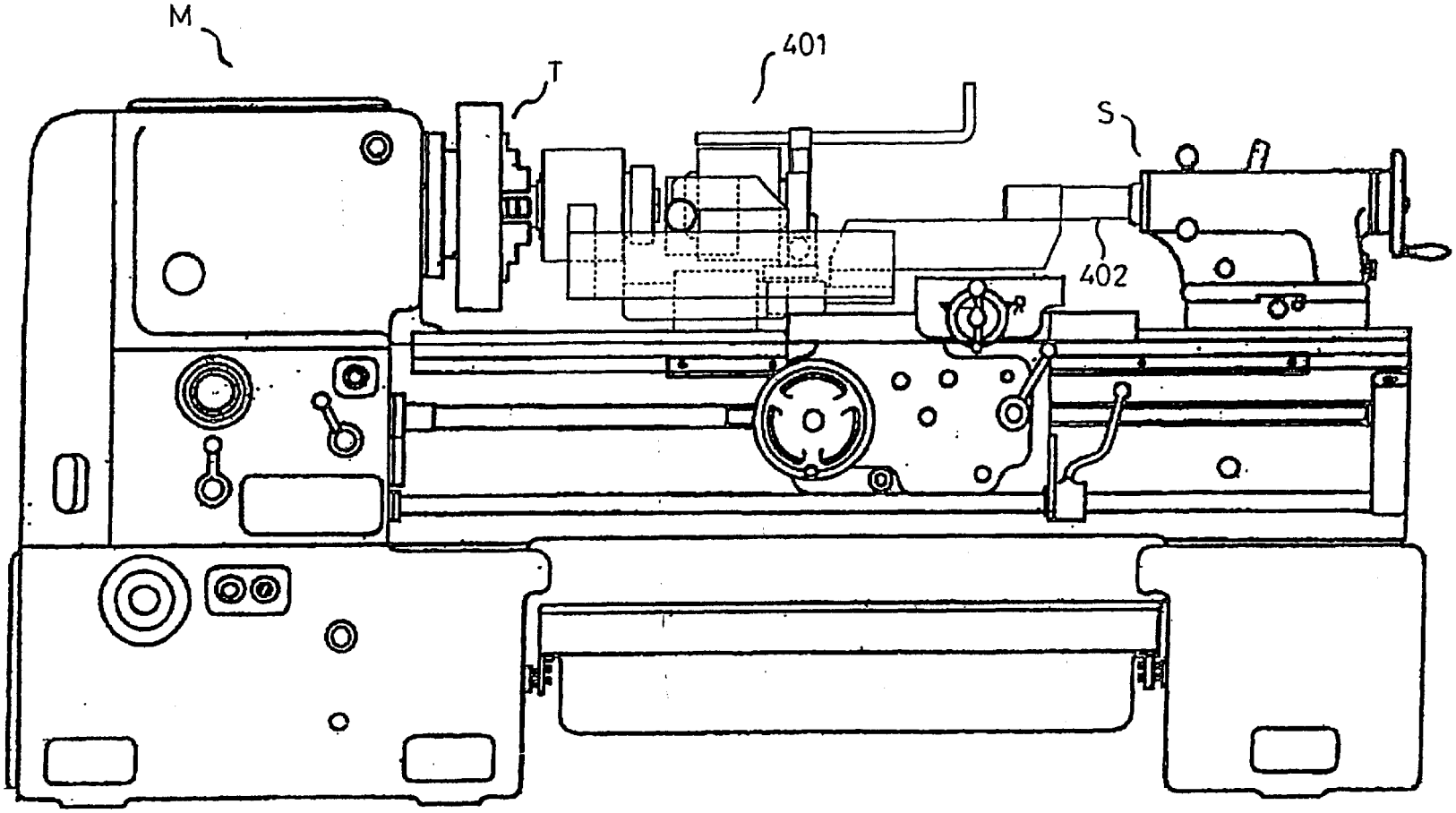
FIG. 36 is a side view of a lathe connected to the apparatus shown in FIG. 32.
Figure 37:
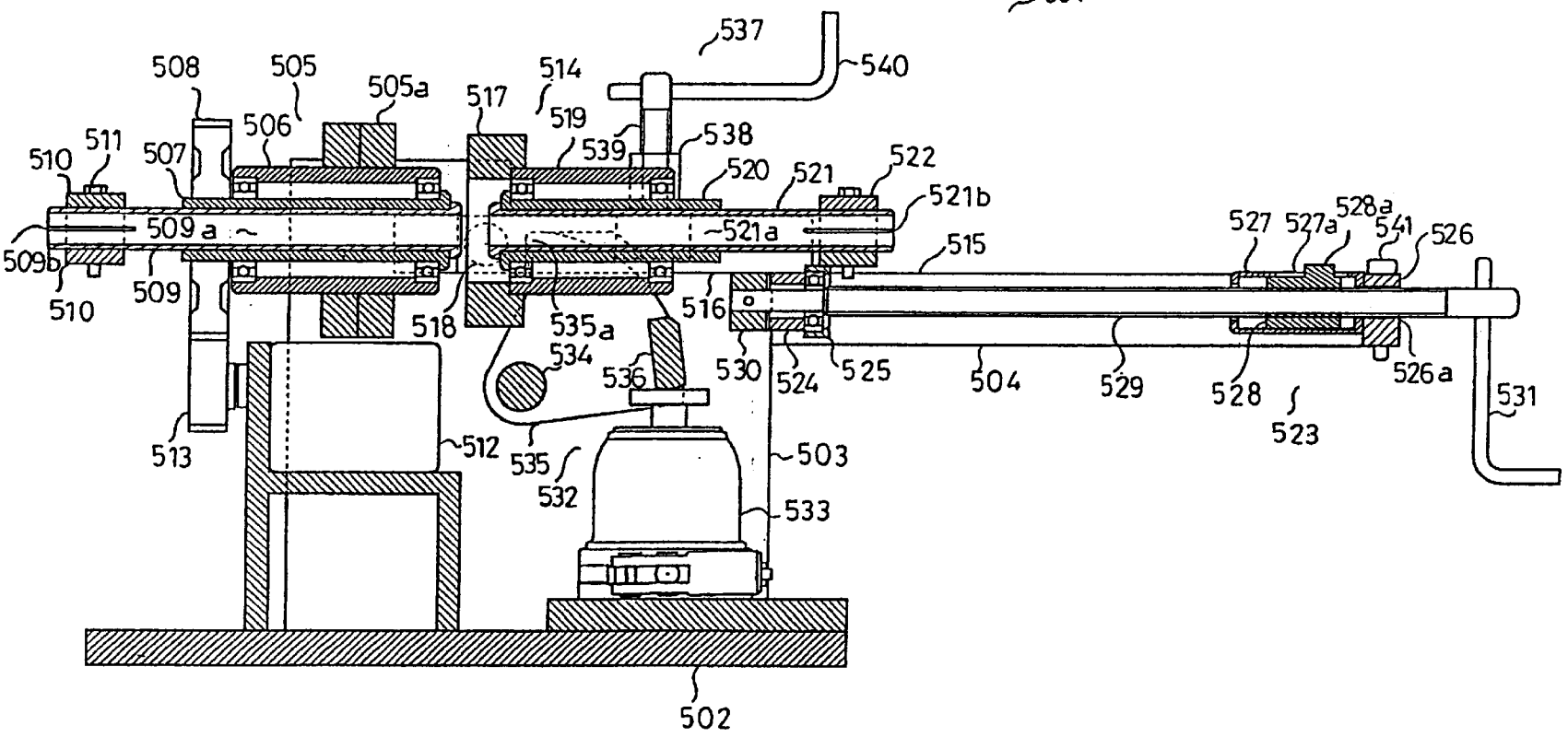
FIG. 37 is a cross-sectional side view of an apparatus according to a still further embodiment of the invention.
Figure 38:
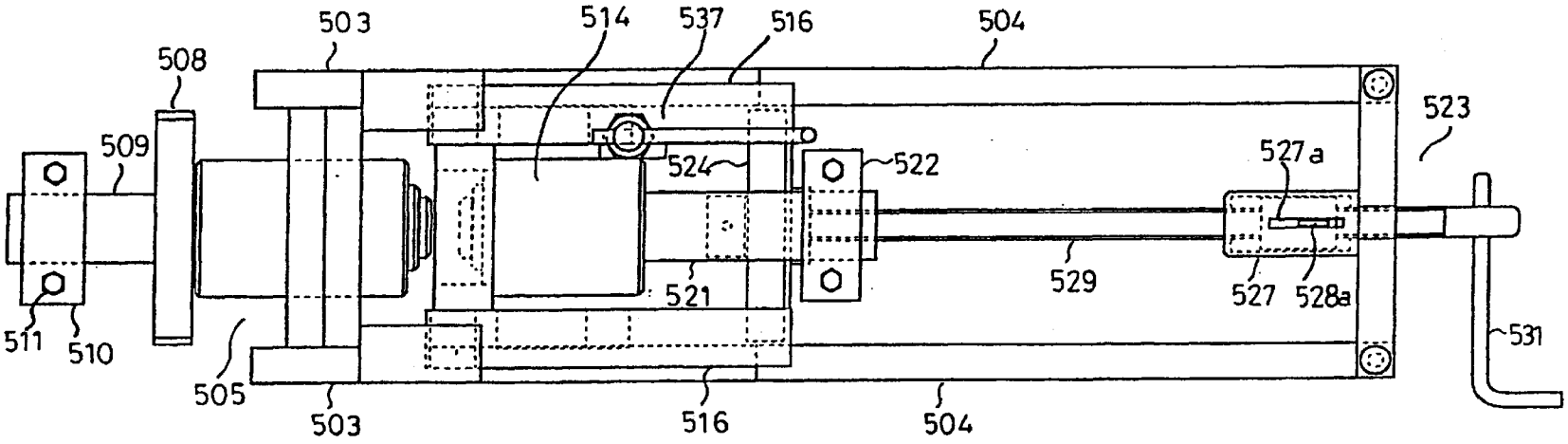
FIG. 38 is a plan view of the apparatus shown in FIG. 37.

In this embodiment a single driving force is transmitted to the rotors 325 and 326 but a modified version as shown in FIG. 30 is also possible in which a motor 341 is provided on the rotary framework 316, with its output shaft having a driving gear 342. The driving gear 342 is engaged with the follower gear 333, and the motors 334 and 341 are controlled by a controller (not shown), thereby effecting the synchronous rotation of the rotors 325 and 326.

Referring to FIG. 31, the procedure for performing the diametral expansion of a shaft by using this embodiment will be described:

The chucks 331 are aligned and a work (W) is inserted between them. The chucks 331 firmly holds the work (W) under the tapered structure of the inner sleeve 329. The distance between the chucks 331 is maintained at D. Then the motor 334 is energized to cause the work (W) to rotate around its axis, and the rotor 326 is caused to approach the rotor 325 until a compressive force P is applied to the work (W). At this stage, the bracket 338 of the transmission 336 is caused to approach the other bracket in accordance with the sliding of the slidable framework 310, thereby shortening the distance of the two brackets. The spline 339 is also shortened, wherein the rotors synchronously rotate because of engagement of the gears 340 with the follower gears 333, as shown in FIG. 31(*a*).

Subsequently, the biasing device 319; that is, the motor 323 is energized to rotate the male thread 324 so as to disengage the feeder nut 321 from it, thereby allowing the rotary framework to rotate around the pivot 318. In this way the rotor 326 secured to the rotary framework 316 is rotated in a biased position with respect to the axis of the rotor 325. The brackets 338 of the rotors 325 and 326 are rotated such that the axes of the bearings 338*a* are aligned, and because of the constant engagement of the follower gear 333 with the gear 340, the synchronous rotation of the rotors 325 and 326 is maintained as shown in FIG. 31(*b*).

While the work (W) is rotated, a bulged portion in the work gradually grows around the periphery of it and finally becomes diametrically expanded as desired. The distance between the chucks 331 is shortened, and the compressive force diminishes. As it becomes smaller than a pull occurring outside the bent portion of the work (W), it is subjected to straightening, and is liable to breakage. To avoid the breakage, the work is kept under the compression (FIG. 31(*c*)).

Upon the achievement of the desired diametral expansion the motor 323 is reversibly rotated, and the chucks 331 are aligned so as to straighten the work (W) under the continued compressive force P. In this condition the work is rotated several times, thus obtaining a straightened work. Then the rotation and application of the compressive force are stopped, and the work is taken out by separating the rotor 325 from the rotor 326 or vice versa by the hydraulic cylinder 315. The work (W) is readily released from the chucks 331, as shown in FIG. 31(*d*)).

FIGS. 32 to 36 show another preferred embodiment in which a lathe is employed. A diametrically expanding apparatus 401 is connected to a lathe (M) (not shown in FIGS. 32 to 35) through a structure in which a base plate 403 is provided for supporting a tapered shaft 402 designed to receive a tail stock of the lathe (M). The base plate 403 consists mainly of parallel side frames 404 along the length of the apparatus, and a front transverse frame 405 and a rear transverse frame 406. An outer sleeve 408 is secured to the front transverse frame 405 for supporting a driving rotary section 407, and the tapered shaft 402 is secured to the rear transverse frame 406 in alignment with the tapered shaft 402. A pressing device 409 is supported on a mount 410 secured to the rear transverse frame 406.

The driving rotary section 407 consists of an arrangement in which an inner sleeve 411 rotatably carried in the outer sleeve 408. The inner sleeve 411 houses chuck sleeves 412 for holding a work (W) in a space whose side wall is tapered at $\alpha°$. The inner sleeve 114 is provided with a male thread engageable with a female thread of a ring 413, wherein the engagement of the threads prevents the inner sleeve 411 from deviation along the length of the apparatus. The front part of the apparatus mentioned above is connected to a chuck (T) of the lathe (M) so as to transmit a torque of the lathe (M) to the driving rotary section 407. In order to secure the transmission of the torque, the front end of the inner sleeve 411 is made multi-angular in accordance with the number of pawls of the lathe chuck; in the illustrated example, triangular in accordance with the three pawls. A cornered shape is effective to transmit a torque with the minimum loss.

The chuck sleeves 412 includes an inside space 412*a* in which the work (W) is placed, and it is split into several chuck pieces so as to hold the work (W) among them. After the work (W) is inserted into the chuck pieces, it is secured by the nut 414 at its rear section. More specifically, the chuck sleeves 412 are pushed backward along the tapered angle at $\alpha°$ by being tightened by the nut, and the space surrounded by them is restricted to hold the work (W).

A driven rotary section 415 is located opposite the driving rotary section 407, and is rotatably mounted on the slidable framework 416 so as to rotate vertically. The slidable framework 416 slides on the side frame 404 along the length of the apparatus. The slidable framework 416 includes slide members 418 secured to side frames 417 between which a front transverse frame 419 and a rear transverse frame 420 are arranged. More specifically, the slidable framework 416 has a sliding surface in the outside of the side frame 417 and the bottom surface of the sliding member 418, and slides along the side frame 404 of the base plate 403.

The driven rotary section 415 includes an outer sleeve 422 in which an inner sleeve 423 is rotatably carried, the outer sleeve 422 having a pivot 421. The inner sleeve 423 is provided with a male thread in its rear section, and an inside space 423*a* having a side tapered at $\beta°$. The inside space 423*a* houses chuck sleeves 424 and a sleeve 425. The chuck sleeves 424 are pushed forward by tightening the nut 426 provided in a rear section, so that the chuck sleeves are split into several chuck pieces among which the work (W) is held.

A hydraulic cylinder 427 as a pressing device 409 is provided between the mount 410 of the base plate 403 and the front transverse frame 419 of the slidable framework 416. No controller for regulating the hydraulic cylinder or no switch are illustrated. When the work (W) is to be compressed held by the driving rotary section 407 and the driven rotary section 415, the hydraulic cylinder 427 is extended so as to shorten the distance between them. A repulsive force involved in the compression is set off in the base frame, so that no load is applied to the lathe (M). Instead of the single-acting cylinder, a double-acting cylinder can be employed, which enable the finished work (W) to be readily taken out of the apparatus.

The driven rotary section 415 is provided with a biasing device 428 for biasing the work (W). The biasing device 428 includes a bracket 429 in which an inside space 429*a* receives a rotating shaft 430 having a female thread. The rotating shaft 430 has a threaded rod 432 provided with a handle 431. The threaded rod 430 is rotated by the handle 431. At this stage, because of the abutment of the lower end of the threaded rod 432 with the top surface of the rear transverse frame 420 the threaded rod 432 is prevented from upward and downward movement but the rotary shaft 430 is caused to move up or down together with the outer sleeve 422. In this way the driven rotary section 415 is vertically rotated around the pivot 421.

The apparatus 401 is operated as follows:

The inner sleeve 411 of the driving rotary section 407 is connected to the chuck (T) of the lathe (M). At the same time, the tapered shaft 402 is connected to the tail stock of the lathe (M).

Subsequently, the driving rotary section 407 and the driven rotary section 415 are aligned, thereby setting the biasing device 428 free. The work (W) is inserted between the chuck sleeves 412 and 424 spaced at a predetermined distance (D). The work (W) is firmly held by tightening the nuts 414 and 426.

The lathe (M) is driven to operate the hydraulic cylinder 427 so as to rotate the work (W) and compress it between the chuck sleeves 412 and 424.

While the work (W) is subjected to rotation and compression, the handle 431 is operated to rotate the driven rotary section 415. At this stage, the distance (D) is shortened, and therefore, the diametral expansion advances. The continued compression is effective to protect the work (W) from breaking owning to bending back. When a desired diametral expansion is finished, the rotary sections 407 and 415 are returned to a position where they are aligned under the maintained rotation and compression. When the work (W) is straightened up, the rotation and compression are stopped, followed by the withdrawal of the work (W).

In this embodiment, the torque is given by a lathe which is protected from an unfavorable repulsive force of the compression. This ensures that all-purpose lathes can be employed.

In the embodiments referred to above the work (W) is a solid metal shaft but it can be hollow like a pipe. Now, referring to FIGS. 37 to 44, the diametral expansion of a metal pipe will be described:

In general, if a machine or a device must be partly be elastic or hermetic, expansion joints or bellows for flexible pipes are used. A process for making bellows is known in the art; one example is described in Japanese Patent Publication 3-42969 which teaches the method of injecting a bulged fluid pressure into a metal pipe. As the internal pressure is increased, the pipe is expanded in accordance with the contour of the mold. However, a disadvantage is that the expanded wall becomes thin. The present invention is directed to diametrically expand metal pipes without reducing the thickness of the expanded portion.

A work (W) is held by a pair of rotary holders aligned at a distance (D). The rotary holders are similar in structure to a chuck of a lathe. If the work (W) is short, a chuck sleeve which can compress one end of the work (W) is used. The distance (D) can be varied between a few tens of millimeters and a few hundreds of millimeters.

In this situation at least one of the rotary holders is rotated to rotate the work (W). The rotating speed depends upon the material and the size of the work, covering a few to a few hundreds of rotations per minute. If the speed is slow, the diametral expansion takes time, and if it is too fast, it is difficult to follow pressure to a plastic deformation, thereby resulting in the possibility of breakage due to fatigue.

Then the work (W) in rotation is subjected to compression, which is applied in a known manner such as a hydraulic jack or a hydraulic cylinder. The strength of the compressive force depends upon the material, the diameter, and the thickness of the work (W). However, in this embodiment the compressive force can be smaller than that required in the bulge process.

While the work (W) is subjected to rotation and compression, it is bent by biasing one of the holders with respect to the axis of the other holder. As a result, the work (W) is bent while being in rotation. The angle of bend is a few to a few tens of angle; if it is too small, a desired diametral expansion is not obtainable. If it is too large, the work (W) is likely to become damaged.

If the work (W) is bent while it is in rotation, a large compressive force acts upon the inside of the bent portion, thereby causing plastic deformation to arise there. Because of the plastic deformation, the work (W) deforms in a direction in which the compressive force escapes; that is, the work (W) diametrically expands. Because of the rotation the plastic deformation spreads around the periphery of the work (W). At this stage it is important to apply a compressive force to outside the bent portion. If a pull acts upon this outside of the work (W), the work (W) is alternately subjected to extension and contraction, and finally fractures owing to fatigue. As the work (W) diametrically expands, the distance (D) between the holders becomes short. Accordingly, the pressure is constantly applied to one of the holders to move toward the other holder, so as to continue to apply the compressive force to the periphery of the work (W). In this way, because the work (W) is subjected to compression and bending while it is in rotation, the compressive force can be smaller than that required in the bulge process.

After the desired diametral expansion is finished, the work (W) is straightened up by returning the rotary holders until they are aligned again under the continued compression applied inside and outside the bent portion. If the compression is reduced, the work (W) is liable to fracture owing to expansion and contraction. After the straightening is finished, the application of the compressive force is stopped, followed by the withdrawal of it.

Because of the rotation and bending applied to the work (W) while being subjected to compression axially applied to the work (W), it becomes shorter than before the diametral expansion is performed. This means that the shortened portion is absorbed in the expanded part, thereby increasing the thickness of the expanded metal flesh. This is advantageous over the bulge processed pipes.

Referring to FIGS. 37 to 44, the illustrated apparatus 501 includes a pair of side walls 503 erected on base plates 502 on the floor, and a rectangular framework 504 which is provided with a driving rotary holder 505.

The driving rotary holder 505 includes an inner sleeve 507 rotatable in an outer sleeve 506 secured to a member 505*a* of the framework 504. The inner sleeve 507 is provided with a driven rotary gear 508 at its rear end, and houses chuck sleeve 509 for holding a work (W) in an inside space 509*a* axially produced. The chuck sleeve 509 is provided with a slit portion 509*b* which is tightened by a bolt 511 through a fastener 510. In this way the work (W) is firmly held in the chuck sleeve.

A motor 512 is provided under the rotary holder 506, having its output shaft provided with a driving gear 513 engaged with the driven gear 508.

Opposite the driving rotary holder 505 is provided a driven rotary holder 514 which includes a slider 516 slidable along rails 515 on the framework 504. A ring-shaped rotary framework 517 is rotatably connected to the slider 516 by a pivot 518. The ring-shaped rotary framework 517 is secured to an outer sleeve 519 in which an inner sleeve 520 is rotatably housed. The inner sleeve 520 houses a chuck sleeve 521, which has the same structure as the chuck sleeve 509, includes an inside space 521*a* axially produced to receive the work (W). The work (W) in the inside space 521*a* is firmly held by narrowing a slit portion 521*b* which is tightened by a fastener 522.

The slider 516 is provided with a feeder 523 designed to move the driven rotary section 514 toward and away from the driving rotary section 505. The slider 516 is provided with a bracket 524 in its rear end on which a bearing 525 is provided. The framework 504A is provided with an opening 526 in its rear transverse frame 526, and a sleeve 527 secured in its front end. The sleeve 527 is provided with a slit 527*a* through which a projection 528*a* of a shifter block 528 is extruded. The shifter block 528 is caused to move to and fro along the length of the apparatus 501.

A feeder rod 529 is rotatably carried by the bearing 525 and the transverse frame 526. The feeder rod 529 is provided with a male thread portion on its periphery with which the shifter block 528 is engaged. The feeder rod 529 is provided with a stop ring 530 at its front end to prevent it from slipping off, and a handle 531 in its rear end.

Below the driven rotary section 514 is provided a pressing device 514, which causes the driven rotary section 514 to move toward the driving rotary section 505, in the form of a hydraulic jack 533 provided on the base plate 502. A cam 535 is rotatably supported on the hydraulic jack 533 such that it can vertically rotate by means of a pivot 534. The cam 535 includes an engager 535*a* engageable with the rear portion of the slider 516, and a receiver 536 to receive an upward urge of the jack by coming into abutment with a piston rod of the jack 533.

A biasing device 537 is provided on the driven rotary section 514 so as to effect the up and down movement of it. The biasing device 537 includes a nut 538 secured to the outer sleeve 519, and a threaded rod 539 engaged with the nut 538. The threaded rod 539 is placed in abutment with the slider 516 it its lower end, and is provided with a handle 540 in its upper end. The rotation of the handle 540 causes the threaded rod 539 to rotate, but because of abutment of its lower end with the top surface of the slider 516 the threaded rod 539 does not move up or down, and the nut 538 engaged with it moves up and down together with the outer sleeve 519. In this way the driven rotary section is caused to rotate vertically.

In operation, the two rotary sections 505 and 514 are arranged such that the respective holders 507 and 520 are aligned, which means that the biasing device is prevented from its biasing work. A work (W) is held between the chuck sleeves 509 and 521 wherein a target portion for the desired diametral expansion is placed in agreement with the rear end of the chuck sleeve 509, and the a fixing member 510 is arranged at a position of the slit 509*b*. Then the work (W) is firmly held by tightening the chuck sleeve 509 with the nut 511.

The chuck sleeves 509 and 521 are positioned at a predetermined distance (D). This distance (D) is based on a calculation that a desired diametral expansion is achieved. To adjust the distance (D), the handle 531 is operated to cause the shifter block 528 to move backward until its projection 528*a* comes into abutment with the rear end of the slit 527*a,* and is further operated to cause the feeder rod 529 to advance gradually. As the top end of the feeder rod 529 is connected to the slider 516, the driven rotary section 514 is advanced along the rails 515 until the desired distance (D) is reached, where the fastner 522 is fitted in the slit 521*b* in the chuck sleeve of the driving rotary section to hold the work (W).

Figure 39:
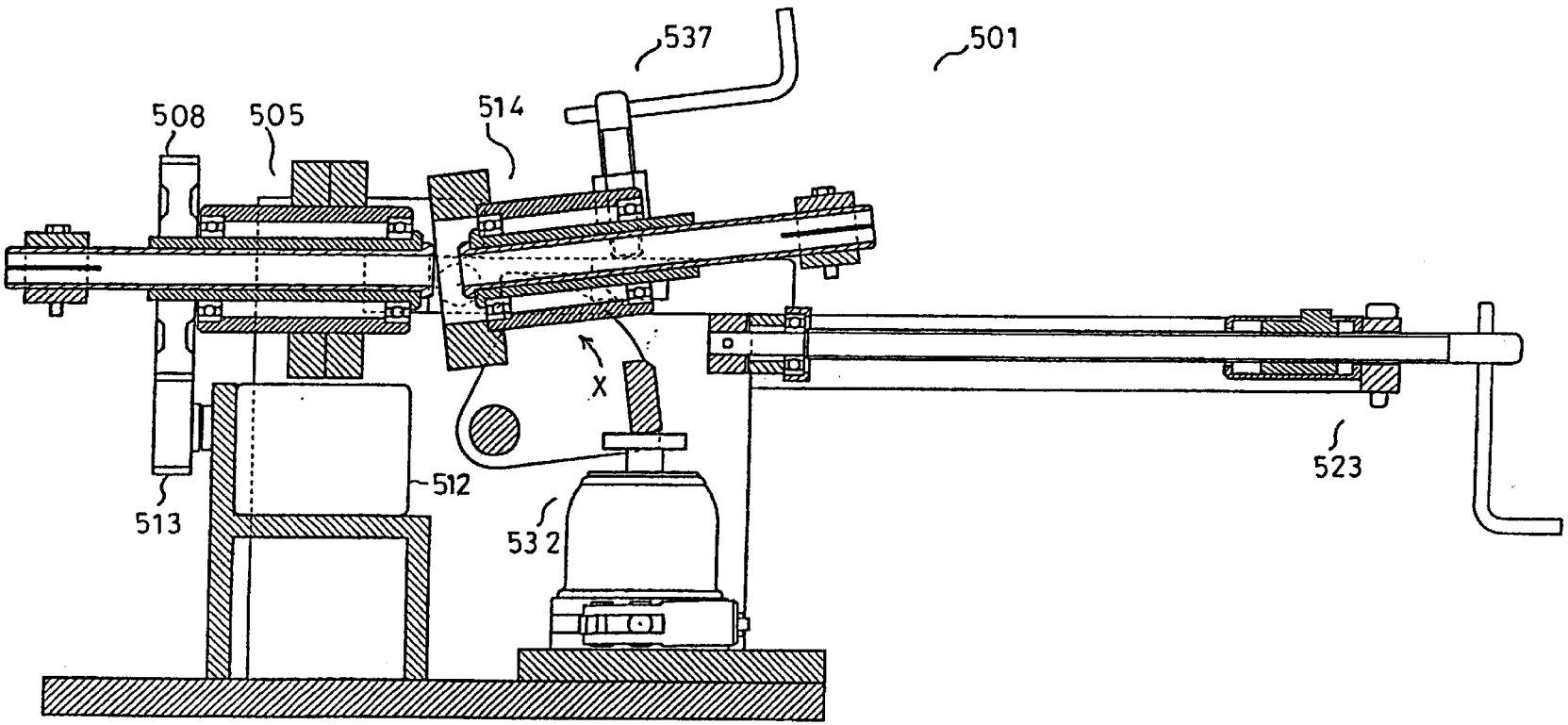
FIG. 39 is a cross-sectional side view explaining the process of performing the diametral expansion.
Figure 40:
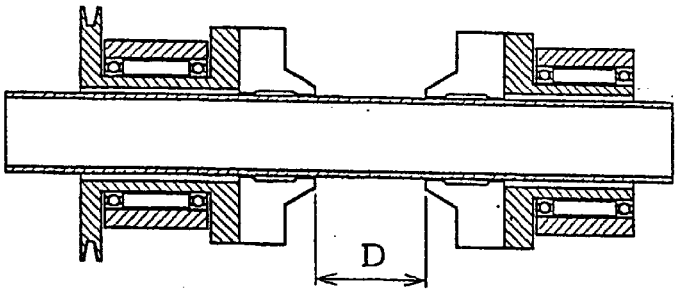
FIG. 40 is a schematic cross-sectional view explaining the first step of performing the diametral expansion where a work is mounted on the apparatus.
Figure 41:
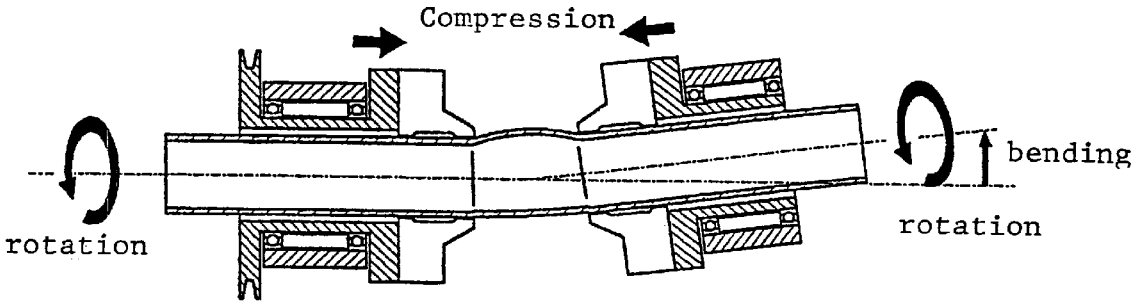
FIG. 41 is a schematic cross-sectional view explaining the second step where the work is subjected to rotation, compression and bending.
Figure 42:
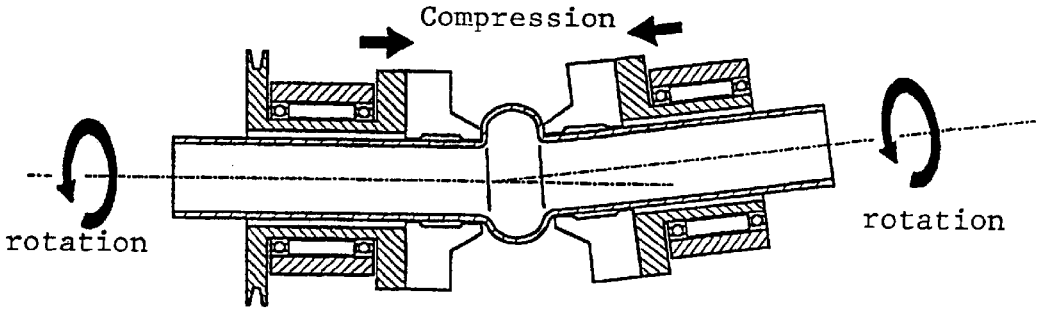
FIG. 42 is a schematic cross-sectional view explaining the third step where the work is subjected to the continued rotation, compression and bending.
Figure 43:
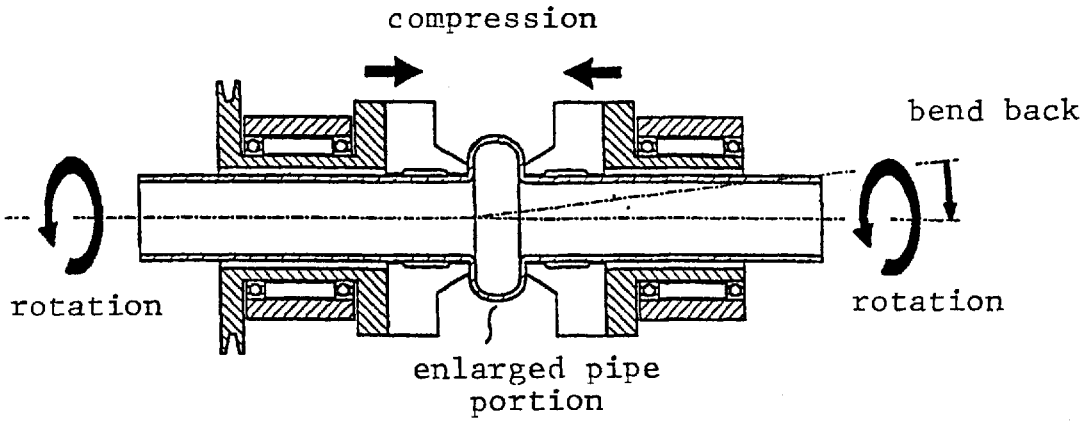
FIG. 43 is a schematic cross-sectional view explaining the fourth step where the work is subjected to straightening up under the continued rotation and compression)
Figure 44:
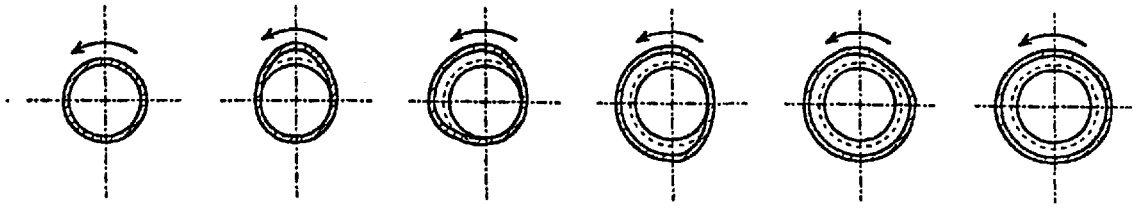
FIG. 44 is a cross-sectional view of a finished diametrically expanded portion of the work.

Subsequently, the pressing device 532 is operated to axially compress the work (W), and the motor 512 is operated. The compression is effected by operating the hydraulic jack 533 and rotating the cam 533 in the direction indicated by the arrow (FIG. 39). The energization of the motor 512 causes the work (W) held by the chuck sleeves 509 and 521 to rotate. In this way, the work (W) is subjected to compression while in rotation. The rotating speed can be a few to a few tens of rotations per minute. Then, the biasing device 537 is operated to bend the work (W) at an angle of 3° to 7°.

Experimentally, this embodiment was applied to a carbon steel pipe having an outside diameter of 22.2 mm, and a thickness of 1.6 mm so as to expand the diameter of a middle portion of it up to 27 mm covering a width of 7 mm around the periphery. As a result, it has been ascertained from this experiment that the rotating speed is 4 rotations per minute, the angle of bend is 6°, and the compression is 1 to 2 tons.

As is evident from the foregoing description, the work (W) is diametrically expanded between the chuck sleeves 509 and 521 by being subjected to compression, rotation, and bending. As the process advances, the original distance (D) is shortened but the compression continues. If it is stopped, the work (W) is subjected to detrimental repetition of bending and straightening, and is liable to fracture. After the desired diametral expansion is finished, the biasing device is returned to its original position so as to straighten up the bent portion in the work (W) under the constant compression. Then the rotation and compression are stopped, and the finished work (W) is taken out of the apparatus.

Initially the work (W) is loosely held between the chuck sleeves 509 and 521 but as the rotation, bending and compression advance, the diametrically expanded portion is tightly held by the chuck sleeves 509 and 521, thereby making it difficult to take the work out of the apparatus. Therefore, the withdrawal of the work (W) is helped by the hydraulic jack 533 in a manner in which it is slid backward, and the cam 535 is lowered in the opposite direction to the arrow direction (FIG. 39). The fastener 522 is unfastened, and the driving rotary section 505 is separated from the driven rotary section 514 to release the work (W). A pin 541 is drawn, and the frame 504 and the transverse frame 526 are released so as to allow the driven rotary section 514 to slide backward until the work (W) is released. Finally, the fixing member 510 is unfastened, and the work (W) is withdrawn from the driving rotary section 505.

ADVANTAGES OF THE PRESENT INVENTION

The present invention makes it easy to diametrically expand a metal shaft or pipe, whichever it is solid or hollow. Gears and cams can be readily provided in a desired portion of metal shafts without welding or mass-cutting. The production of mechanical power transmissions is facilitated.

What is claimed is:

1. A method for diametrically expanding a metal shaft, comprising the steps of:

holding the shaft between a pair of holders spaced at a distance (D);

rotating the work around its axis, moving one of the holders toward the other holder so as to compress the work;

biasing one of the holders in a direction which crosses the axis of the other holder, so as to bend the work and build up bulged portions accruing inside the bent portion around the periphery of the work within the distance (D) until a desired expansion is achieved; and straightening up the work;

wherein the compression is constantly applied to both the inner and outer sides of the work to be bent, and the rotation is initiated at the latest immediately after the bending is started, and the straightening-up is performed under the continued compression and rotation.

2. The method according to claim 1, wherein the compression is relatively low at the initial stage of the diametral expansion, and progressively increases as the diametral expansion advances.

3. An apparatus for diametrically expanding a metal shaft, comprising:

a driving rotary section (4) and a driven rotary section (6) arranged at a predetermined distance, each of the rotary sections comprising holders for securing a work between them;

a driver (5) for operating the driving rotary section (4);

a pressing device (8) for axially compressing the work held by the holders; and a biasing device (7) for declining the axis of the work;

wherein the pressing device (8) applies the compression to one of the rotary sections (4) and (6), and the biasing device (7) declining the other rotary section (4) or (6).

4. An apparatus for diametrically expanding a a metal shaft, comprising:

a driving rotary section (103) and a driven rotary section (105) arranged at a predetermined distance, each of the rotary sections comprising holders for securing a work therebetween;

a driver (104) for operating the driving rotary section (103);

a pressing device (109) for axially compressing the work held by the holders; and a biasing device (108) for declining the axis of the work;

wherein either the driving rotary section (103) or the driven rotary section (105) is arranged rotatably around a pivot (107*a*) provided in a direction perpendicular to the axis of the work, and the rotatably arranged rotary section is supported by the pivot (107*a*) so as to enable the simultaneous inspection of the inner and outer sides of the bent portion of the work.

5. The apparatus according to claim 4, further comprising a slidable frame (106) provided on the base plate (102), and a rotary framework (107) rotatably connected to the slidable frame (106) through a bearing, and wherein the driving rotary section (103) is secured to the base plate (102) and the driven rotary section (105) is secured to the rotary framework (107).

6. An apparatus for diametrically expanding a metal shaft, comprising:

a driving rotary section (205) and a driven rotary section (225) arranged opposite each other, each of the rotary sections comprising holders for securing a work between them;

a driver (214) for rotating the work held by the holders around its axis;

a first slidable pressing device (206) for causing the driven rotary section (225) to move toward and away from the driving rotary section (203);

a biasing device (230) for rotating the driven rotary section so as to decline with respect to the axis of the holder of the driving rotary section;

a second slidable pressing device (226) for shifting the axis of a pivot rotated by the biasing device (23) toward and away from the driving rotary section; and a displacing device for shifting the center of rotation between the holders in accordance with a sliding distance covered by each of the first pressing devices (206) and the second pressing device (226).

7. An apparatus for diametrically expanding a metal shaft, comprising:

a driving rotary section (205) and a driven rotary section (225) arranged opposite each other, each of the rotary sections comprising holders for securing a work therebetween;

a driver (214) for rotating the work held by the holders around its axis;

a biasing device (230) for rotating either the driving rotary section (205) or the driven rotary section (225) with respect to the axis of the holder of the other rotary section;

a first slidable pressing device (206) and a second slidable pressing device (226) for moving the driving rotary sections (205) and (225) toward and away from the axis of a pivot (223) rotated by the biasing device (23); and a displacing device for shifting the axis of the pivot between the holders in accordance with a sliding distance covered by each of the two pressing devices (206) and (226).

8. An apparatus for diametrically expanding a metal shaft, comprising:

a pair of rotary sections (325) and (326);

a holder provided in each of the rotary sections for holding a work;

a sliding device (311) for causing at least one of the rotary sections to move toward and away from the other rotary section;

a biasing device (319) for declining at least one of the rotary sections with respect to the axis of the other rotary section;

a driver (332) for rotating the work held by the holders around its axis; and a transmission (336) for transmitting the torque of one rotary section to another so as to effect the synchronous rotation of the two rotary sections (325) and (326).

9. The apparatus according to claim 8, wherein the transmission (336) comprises a rotating division in which rotatable brackets (338) are provided, having a pair of splines (339) interposed between them, the splines comprising gear (340) engaged with follower gear (333) provided in the rotating division, thereby transmitting a torque of one of the rotating division to the other.

10. An apparatus for diametrically expanding a metal shaft, comprising:

a driving rotary section (407) provided with a first work holder and being capable of rotating the work held by the holder;

a driven rotary section (415) provided with a second work holder on an opposite side to the holder of the driving rotary section (407) and being capable of moving toward and away from the driving rotary section (407);

a biasing device (428) for declining the second holder with respect to the axis of the first holder; and a pressing device (409) for pressing the driven rotary section (415) toward the driving rotary section (407);

wherein the driving rotary section is driven by an arrangement in which the first work holder is connected to a chuck of a lathe (M) so as to utilize the torque of the lathe (M).

11. The apparatus according to claim 10, wherein the pressing device (409) is placed between a base plate (403) and a slidable frame (416), and wherein the base plate (403) is provided with a tapered shaft (402), the tapered shaft and the first work holder being connected to the lathe (M), thereby compensating a repulsive force involved in operating the pressing device within the base plate.

* * * * *